US009061341B2

(12) United States Patent
Kobayashi

(10) Patent No.: US 9,061,341 B2
(45) Date of Patent: Jun. 23, 2015

(54) HOT-PRESSING DEVICE AND METHOD OF MANUFACTURING HOT-PRESSED PRODUCT

(71) Applicant: TOPRE CORPORATION, Tokyo (JP)

(72) Inventor: Masanori Kobayashi, Kanagawa (JP)

(73) Assignee: Topre Corporation, Tokyo (JP)

( * ) Notice: Subject to any disclaimer, the term of this patent is extended or adjusted under 35 U.S.C. 154(b) by 74 days.

(21) Appl. No.: 14/105,657

(22) Filed: Dec. 13, 2013

(65) Prior Publication Data

US 2014/0305181 A1 Oct. 16, 2014

(30) Foreign Application Priority Data

Apr. 12, 2013 (JP) ..... 2013-083678

(51) Int. Cl.
*B21D 37/16* (2006.01)
*B21D 22/20* (2006.01)

(52) U.S. Cl.
CPC ..... *B21D 37/16* (2013.01); *B21D 22/208* (2013.01)

(58) Field of Classification Search
CPC .... B21D 37/16; B21D 22/208; B21D 22/286; H01L 23/473
USPC ..... 72/41, 43–45, 341.1–342.8, 342.92, 72/476, 379.2, 379.6, 373–376; 148/643, 148/647, 654, 661; 165/48.1; 137/340
See application file for complete search history.

(56) References Cited

FOREIGN PATENT DOCUMENTS

JP 2002282951 10/2002

*Primary Examiner* — Peter DungBa Vo
*Assistant Examiner* — Joshua D Anderson
(74) *Attorney, Agent, or Firm* — Kilpatrick Townsend & Stockton LLP

(57) ABSTRACT

A hot-pressing device includes a forming surface having a shape corresponding to a predetermined shape into which a workpiece is to be formed and a plurality of coolant channels formed therein so as to be arranged side by side and each having an opening in a side surface thereof when the forming surface is viewed from above or below. The forming surface includes a plurality of grooves formed therein so as to correspond to the coolant channels, a plurality of connection holes formed in each of the grooves so as to be connected to one of the coolant channels corresponding to the groove, the connection holes having openings at positions separated from each other, and a first connection groove connecting a portion of one of the grooves located between two adjacent connection holes to another one of the grooves located adjacent to the one of the grooves.

10 Claims, 16 Drawing Sheets

HOT-PRESSING DEVICE AND METHOD OF MANUFACTURING HOT-PRESSED PRODUCT

CROSS REFERENCES TO RELATED APPLICATIONS

This application claims priority to Japanese Priority Patent Application JP 2013-083678 filed in the Japan Patent Office on Apr. 12, 2013, the entire contents of which are hereby incorporated by reference.

BACKGROUND

1. Field

The present disclosure relates to a hot-pressing device and a method of manufacturing a hot-pressed product, and in particular, to a hot-pressing device and a method of manufacturing a hot-pressed product with which a workpiece is press-formed while simultaneously quench-hardened by using a coolant.

2. Description of the Related Art

There is a hot-press-forming method for obtaining a high-strength and high-precision press-formed product by press-forming a workpiece, such as a steel plate, by using a die while simultaneously quench-hardening the workpiece with the die. Japanese Unexamined Patent Application Publication No. 2002-282951 describes a technology for quench-hardening a workpiece by removing heat not only through contact between the workpiece and a die but also through contact between the workpiece and a coolant.

Japanese Unexamined Patent Application Publication No. 2002-282951 discloses a press-forming device that uses water, an aqueous solution dispersed with synthetic particles, or the like as a coolant. The press-forming device includes a plurality of coolant grooves that are formed in a forming surface of a die (or a punch) so as to be arranged side by side with predetermined distances therebetween and a coolant circulation device that supplies the coolant to and recovers the coolant from the coolant grooves (see paragraphs [0024] and [0027], and FIGS. 2 and 3). In a hot-press-forming process performed by using the press-forming device, the punch is maintained in a state in which the punch has reached a bottom dead center position. In this state, the coolant is circulated into spaces formed between the coolant grooves and the workpiece, thereby cooling the workpiece so as to quench-harden the workpiece. The punch is maintained at the bottom dead center at least until the temperature of the workpiece has decreased to a predetermined value.

In the cooling process, both the die and the coolant remove heat from the workpiece. To be specific, in areas of the forming surface of the die in which the grooves are not formed, the die directly contacts the workpiece and removes heat from the workpiece. In areas of the forming surface in which the grooves are formed, the coolant contacts the workpiece and removes heat from the workpiece.

In the die of the hot-pressing device described in Japanese Unexamined Patent Application Publication No. 2002-282951, an inlet for introducing the coolant into the coolant grooves is located at a middle portion of the forming surface of the die. Outlets for discharging the coolant from the coolant grooves are located on both sides of matching surfaces of the die and the punch (see FIG. 2 of Japanese Unexamined Patent Application Publication No. 2002-282951). That is, the coolant, which is introduced into the coolant grooves through the inlet, flows along a bottom wall, side walls, and flange portions of the workpiece; and the coolant is discharged from the outlet (see paragraph [0037]).

Therefore, for the die of the hot-pressing device described in Japanese Unexamined Patent Application Publication No. 2002-282951, the path length along which the coolant flows in contact with the workpiece is comparatively large. Accordingly, there is a large difference between the temperature of the coolant that has just been introduced into the coolant grooves and the temperature of the coolant immediately before being discharged. Therefore, the farther a portion of the workpiece is from the inlet, the lower the cooling efficiency of the coolant at the portion. As a result, a defect due to nonuniform cooling may occur, because different portions of the workpiece are cooled to different degrees.

As the cooling efficiency decreases, the time required to quench-harden a workpiece increases. Therefore, it becomes difficult to increase the productivity by decreasing the time for which the workpiece is held in the die. When the workpiece is nonuniformly cooled, different portions of the workpiece may be quench-hardened to different degrees, and the precision of the dimensions of a hot-pressed product obtained through the hot-press-forming process may decrease.

SUMMARY

The present disclosure provides a hot-pressing device and a method of manufacturing a hot-pressed product with which high productivity can be achieved without decreasing the precision of dimensions of a hot-pressed product.

The present disclosure provides hot-pressing devices and a hot-pressing method described below.

1) According to an embodiment, a hot-pressing device for hot-press-forming a workpiece into a predetermined shape includes a forming surface having a shape corresponding to the predetermined shape, and a plurality of coolant channels formed therein so as to be arranged side by side and each having an opening in a side surface that is located on a side thereof when the forming surface is viewed from above or below. The forming surface includes a plurality of grooves formed therein so as to correspond to the coolant channels, a plurality of connection holes formed in each of the grooves so as to be connected to one of the coolant channels corresponding to the groove, the connection holes having openings at positions separated from each other, and a first connection groove connecting a portion of one of the grooves located between two adjacent connection holes to another one of the grooves located adjacent to the one of the grooves.

2) According to another embodiment, a hot-pressing device for hot-press-forming a workpiece into a predetermined shape includes an upper die and a lower die that move closer to and away from each other so as to hot-press-form the workpiece, an inlet pipe connected to one of the coolant channels, a recovery pipe connected to another one of the coolant channels located adjacent to the one of the coolant channels, and a coolant circulation device that circulates a coolant by introducing the coolant into the inlet pipe and recovering the coolant from the recovery pipe. At least one of the upper die and the lower die includes a forming surface having a shape corresponding to the predetermined shape, a plurality of coolant channels formed therein so as to be arranged side by side and each having an opening in a side surface thereof, a plurality of grooves formed in the forming surface so as to correspond to the coolant channels, a plurality of connection holes formed in each of the grooves so as to be connected to one of the coolant channels corresponding to the groove, the connection holes having openings at positions separated from each other, and a first connection groove connecting a portion of one of the grooves located between two adjacent connection holes to another one of the grooves located adjacent to the one of the grooves.

3) According to another embodiment, a method of manufacturing a hot-pressed product having a predetermined shape by hot-pressing a workpiece by moving an upper die and a lower die closer to and away from each other is provided. The method includes preparing the upper die and the lower die, inserting the workpiece, which has been heated, between the upper die and the lower die, deforming the workpiece by moving the upper die closer to the lower die and maintaining the upper die at a bottom dead center position, and cooling the workpiece with a coolant by introducing the coolant into one of the plurality of coolant channels and recovering the coolant from another one of the coolant channels located adjacent to the one of the coolant channels in a state in which the upper die is maintained at the bottom dead center position. At least one of the upper die and the lower die includes a forming surface having a shape corresponding to the predetermined shape, a plurality of coolant channels formed therein so as to be arranged side by side and each having an opening in a side surface thereof, a plurality of grooves formed in the forming surface so as to correspond to the coolant channels, a plurality of connection holes formed in each of the grooves so as to be connected to one of the coolant channels corresponding to the groove, the connection holes having openings at positions separated from each other, and a first connection groove connecting a portion of one of the grooves located between two adjacent connection holes to another one of the grooves located adjacent to the one of the grooves.

The embodiments have an advantage in that high productivity can be achieved without decreasing the precision of dimensions of a hot-pressed product.

DESCRIPTION OF THE EMBODIMENTS

Referring to FIGS. 1 to 19, a hot-pressing device according to an embodiment, and in particular, a pair of dies (a punch 1 and a die 41) and their modifications, will be described. The hot-pressing device described below hot-press-forms a steel plate, which is an example of a workpiece, into a predetermined shape (in this embodiment, a hat-like shape), and thereby obtains a hot-pressed product Ws (hereinafter, simply referred to as a product Ws). The product Ws, which is a press-formed product obtained through a hot-press-forming process, may be further subjected to another process (such as welding or punching). The pair of dies include the punch 1, which is a male die, and the die 41, which is a female die. In this example, the punch 1 is used as a lower die. Alternatively, the punch 1 may be used as an upper die, and the die 41 may be used as a lower die.

Figure 1:
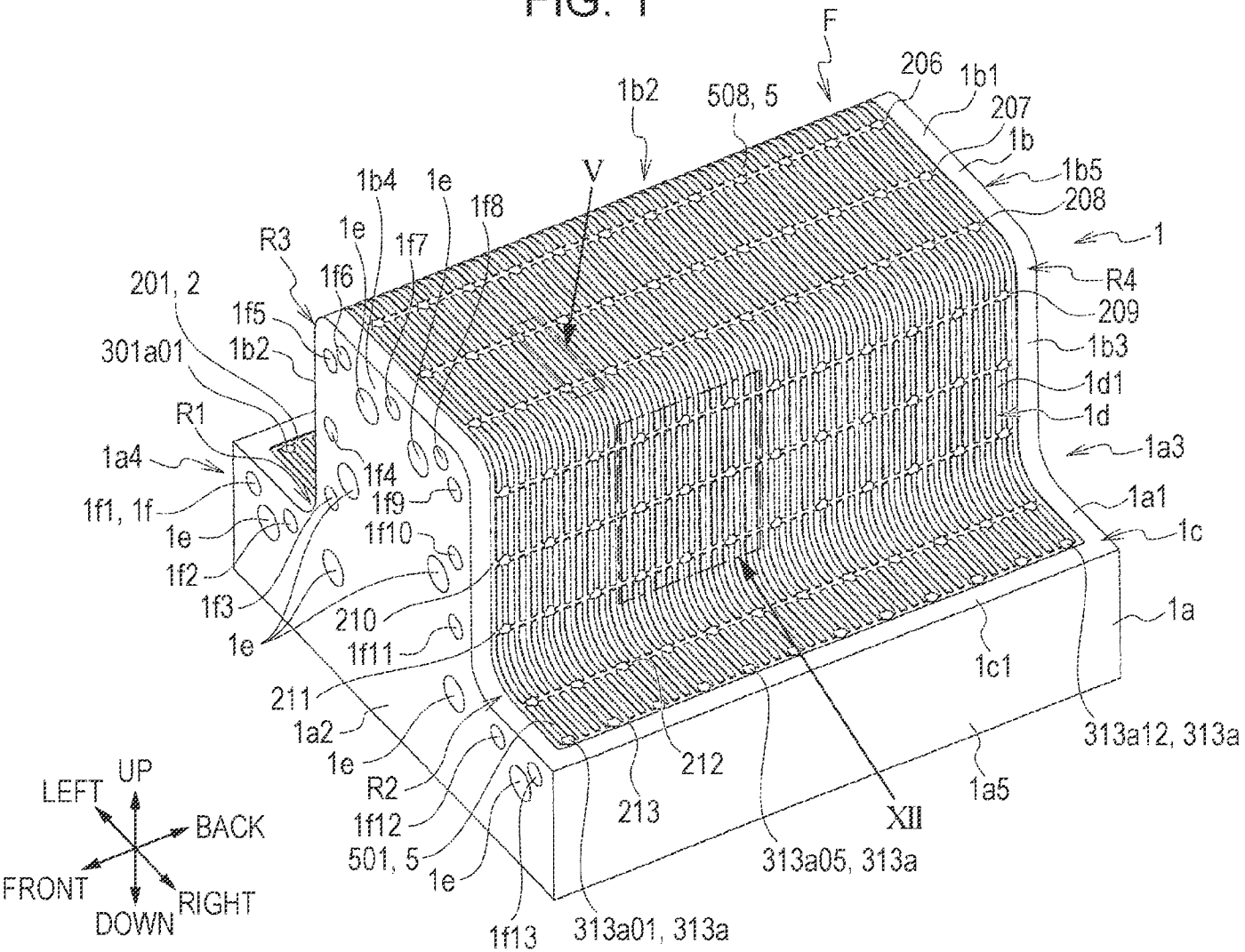
FIG. 1 is perspective view illustrating a punch, which is a hot-pressing device according to an embodiment.
Figure 2:
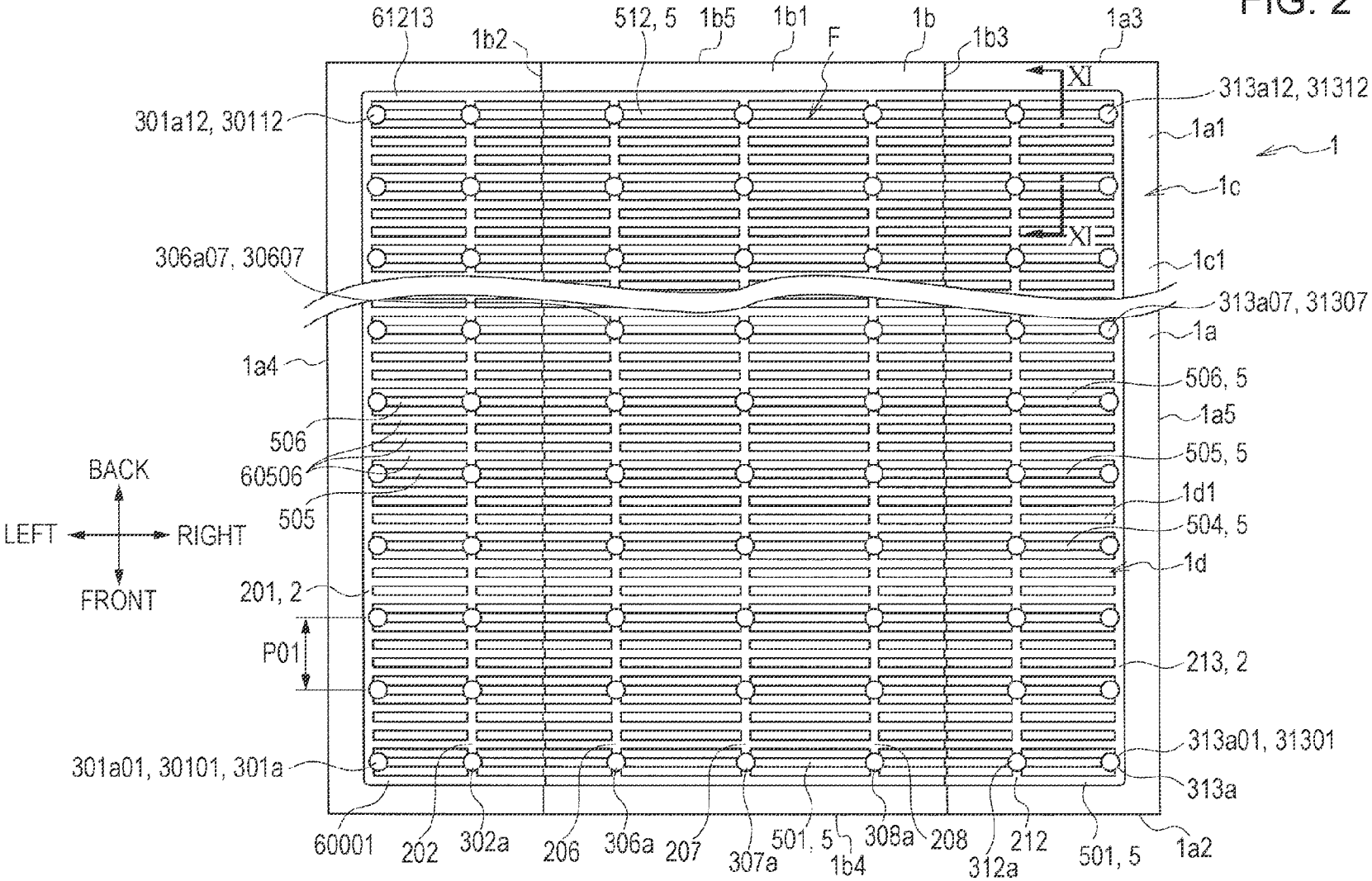
FIG. 2 is a top view of the punch.
Figure 3:
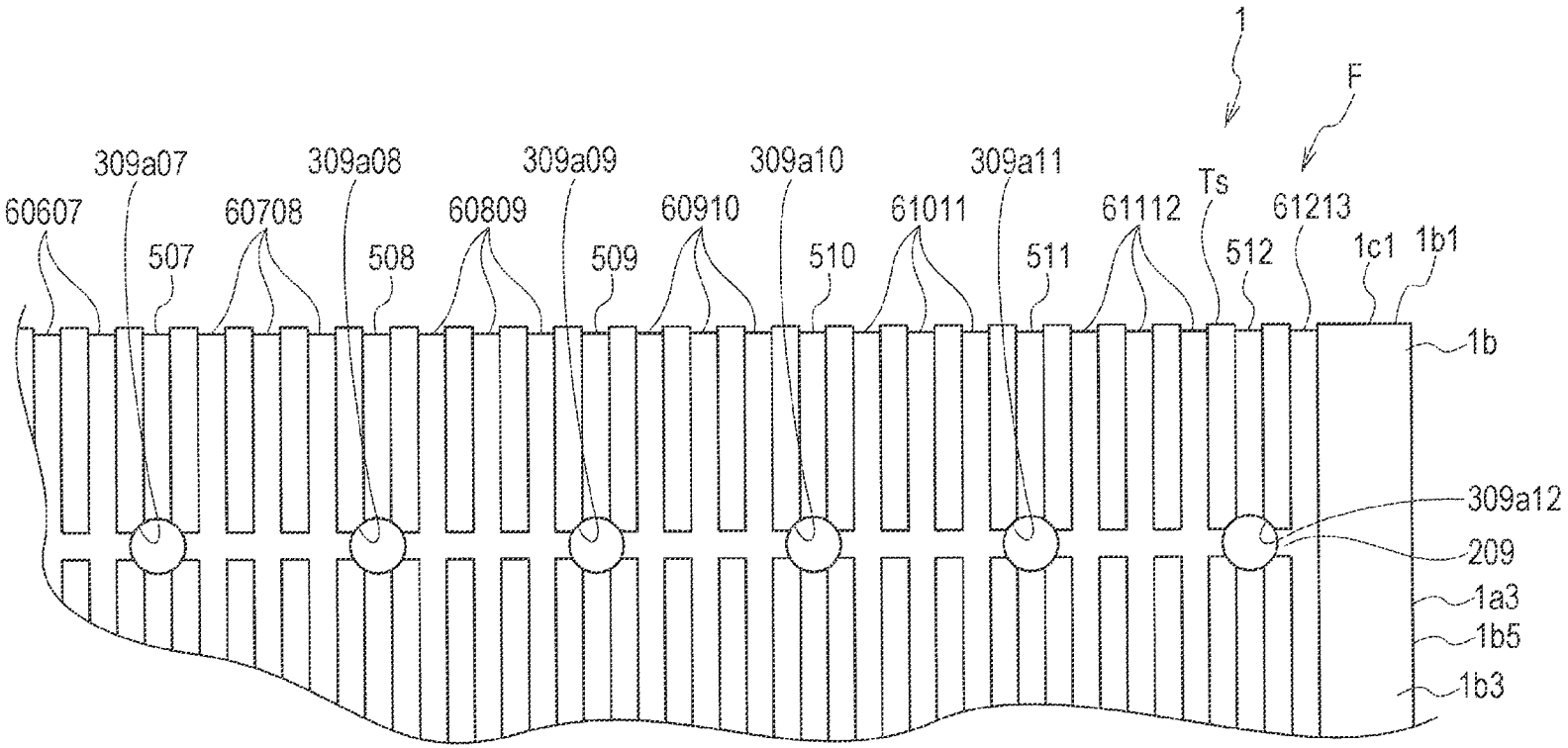
FIG. 3 is a partial right side view of the punch.
Figure 4:
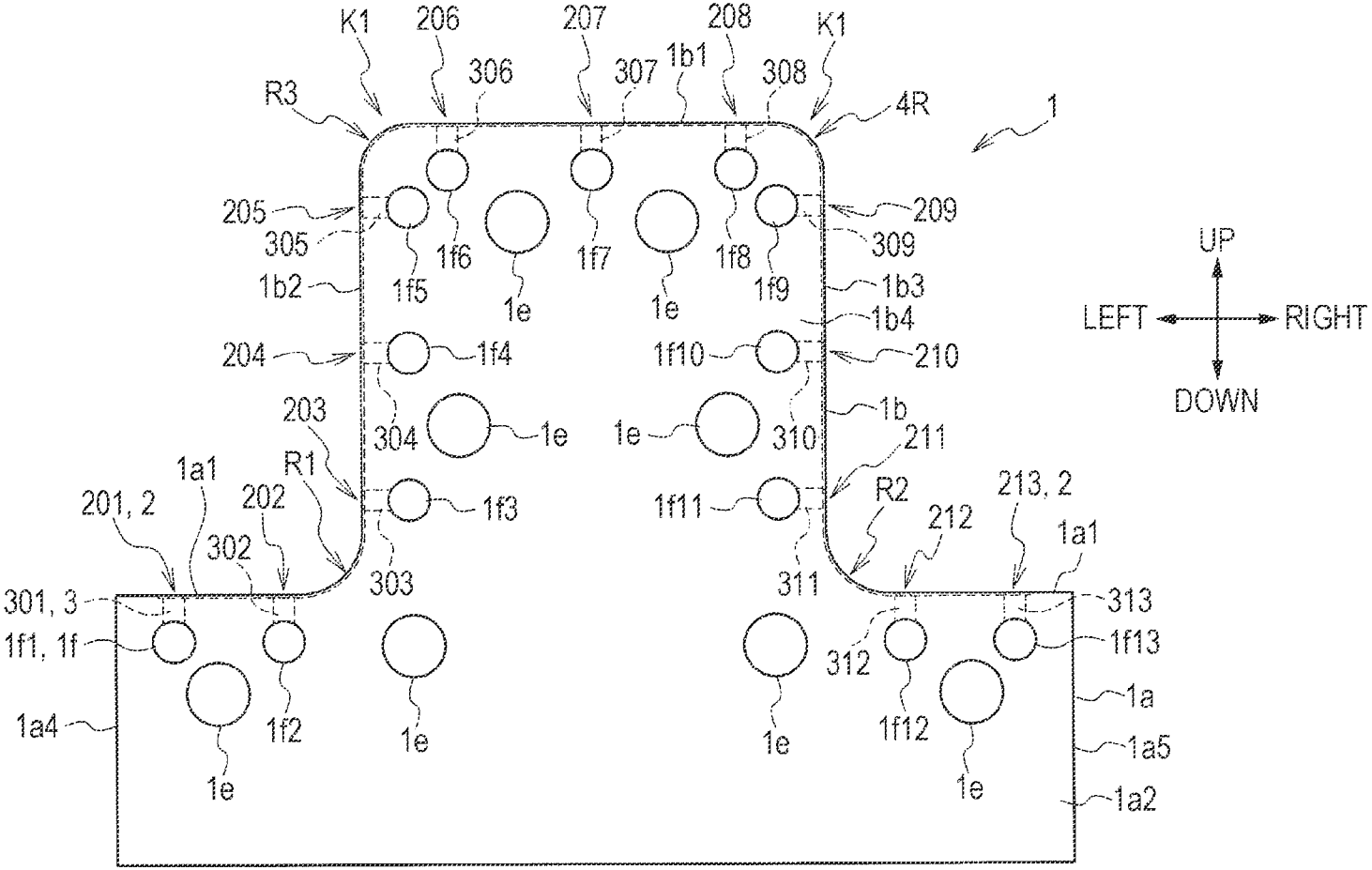
FIG. 4 is a front view of the punch.
Figure 5:
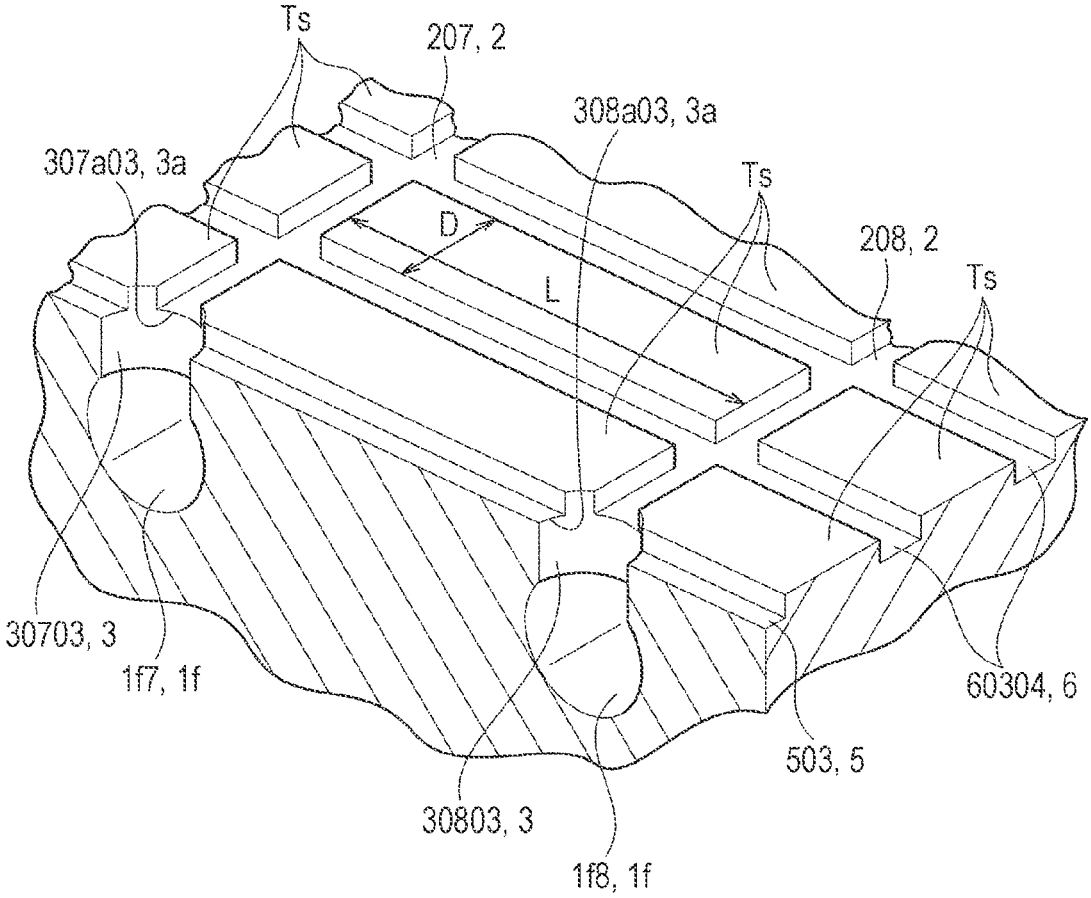
FIG. 5 is a perspective sectional view of a portion V of the punch shown in FIG. 1.

First, the punch 1 will be described with reference to FIGS. 1 to 5. For ease of understanding the following description, up, down, front, back, left, and right are defined as the directions indicated by arrows in FIG. 1. FIG. 1 is a top perspective view of the punch 1 viewed from the front right. FIG. 2 is a top view of the punch 1. FIG. 3 is a partial right side view of an upper back end portion of the punch 1. FIG. 4 is a front view of the punch 1. FIG. 5 is a top perspective sectional view of a portion V of the punch 1 shown in FIG. 1, viewed from the front right.

The punch 1 includes a base portion 1*a* and a protruding portion 1*b*. The base portion 1*a* is rectangular-parallelepiped-shaped and has a pair of left and right upper surfaces 1*a*1, a front surface 1*a*2, a back surface 1*a*3, a left surface 1*a*4, and a right surface 1*a*5. The protruding portion 1*b* is disposed between the left and right upper surfaces 1*a*1, extends in the front-back direction, and protrudes upward. The protruding portion 1*b* is rectangular-parallelepiped-shaped and has an upper surface 1*b*1, a left surface 1*b*2, a right surface 1*b*3, a front surface 1*b*4, and a rear surface lbs. The front surface 1*b*4 of the protruding portion 1*b* and the front surface 1*a*2 of the base portion 1*a* are on the same plane, and the rear surface 1*b*5 of the protruding portion 1*b* and the rear surface 1*a*3 of the base portion 1*a* are on the same plane.

Rounded fillets R1 and R2 are respectively formed in a region at which the left upper surface 1*a*1 of the base portion 1*a* is connected to the left surface 1*b*2 of the protruding portion 1*b* and in a region at which the right upper surface 1*a*1 of the base portion 1*a* is connected to the right surface 1*b*3 of the protruding portion 1*b*. In other words, the fillets R1 and R2 are formed at internal corner portions extending in the front-back direction. Rounded fillets R3 and R4 are respectively formed at left and right external corner portions (ridge portions), which are formed at upper ends of the protruding portion 1*b* so as to extend in the front-back direction. The portions at which the fillets R3 and R4 are formed will be referred to as shoulder portions K1.

Edge portions of the upper surfaces 1*a*1 of the base portion 1*a* near to the surfaces 1*a*2 to 1*a*5 and edge portions of the protruding portion 1*b* near to the front surface 1*b*4 and the rear surface 1*b*5 serve as a non-forming surface 1*c*1 that does not contact the workpiece W during a hot-press-forming process. A portion of the punch 1 having the non-forming surface

1*c*1 will be referred to as a non-forming portion 1*c*. The non-forming surface 1*c*1 has a frame-like shape when seen from above (see FIG. 2).

A surface surrounded by the non-forming surface 1*c*1 has a shape corresponding to a predetermined shape into which a workpiece is to be formed in a hot-press-forming process. Hereinafter, this surface will be referred to as a forming surface 1*d*1. That is, the forming surface 1*d*1 includes parts of the upper surfaces 1*a*1 of the base portion 1*a* and parts of the upper surface 1*b*1, the left surface 1*b*2, and the right surface 1*b*3 of the protruding portion 1*b*. A portion of the punch 1 having the forming surface 1*d*1 will be referred to as a forming portion 1*d*.

The punch 1 has a plurality of (in this example, eight) through-holes 1*e* extending therethrough from the front surface 1*b*4 to the rear surface 1*b*5 in the front-back direction. As illustrated in FIG. 4, the through-holes 1*e* are formed at positions that are separated from the forming surface 1*d*1 by substantially the same distance. In other words, the through-holes 1*e* are arranged so as to extend along the profile (the surfaces) of the punch 1 when seen from the right side. The through-holes 1*e* function as cooling water passages for cooling the punch 1. During a hot-press-forming process, a coolant such as water is constantly circulated through the through-holes 1*e*.

The punch 1 has a plurality of coolant channels 1*f* extending therethrough from the front surface 1*b*4 to the rear surface 1*b*5 in the front-back direction. The coolant channels 1*f* are formed at positions closer to the forming surface 1*d*1 than those of the through-holes 1*e*. In this example, thirteen coolant channels 1*f*, which will be referred to as coolant channels 1*f*1 to 1*f*13 from the left side, are formed.

All of the coolant channels 1*f* are disposed within the width of the forming surface 1*d*1 in the left-right direction in FIG. 4. To be specific, each of the coolant channels 1*f* are formed so as to correspond to one of the following surfaces: the left and right upper surfaces 1*a*1 of the base portion 1*a*; and the left surface 1*b*2, the upper surface 1*b*1, and the right surface 1*b*3 of the protruding portion 1*b*. The coolant channels 1*f* are separated from these surfaces by substantially the same distance. To be specific, as illustrated in FIG. 4, the coolant channels 1*f*1 and 1*f*2 are formed so as to correspond to the left upper surface 1*a*1, the coolant channels 1*f*3 to 1*f*5 are formed so as to correspond to the left surface 1*b*2 of the protruding portion 1*b*, the coolant channels 1*f*6 to 1*f*8 are formed so as to correspond to the upper surface 1*b*1 of the protruding portion 1*b*, the coolant channels 1*f*9 to 1*f*11 are formed so as to correspond to the right surface 1*b*3 of the protruding portion 1*b*, and the coolant channels 1*f*12 and 1*f*13 are formed so as to correspond to the right upper surface 1*a*1.

At least in a part of the forming portion 1*d*, grooves 2 (hereinafter, referred to as longitudinal grooves 2) are formed so as to extend in the front-back direction, and grooves 5 (hereinafter, referred to as transversal grooves 5) are formed so as to intersect the longitudinal grooves 2. In the punch 1, the longitudinal grooves 2 and the transversal grooves 5 are formed in a grid pattern over substantially the entire area of the forming portion 1*d*. The longitudinal grooves 2 are arranged side by side so as to extend along the protruding portion 1*b* (in the front-back direction). In the punch 1, thirteen longitudinal grooves 2, which will be referred to as longitudinal grooves 201 to 213 from the left side, are arranged parallel to each other.

The longitudinal grooves 201 to 213 are respectively disposed at positions corresponding to those of the coolant channels 1*f*1 to 1*f*13. As illustrated in FIG. 4, connection paths 3 (connection paths 301 to 313) are formed so as to respectively connect the longitudinal grooves 201 to 213 to the coolant channels 1*f*1 to 1*f*13. The connection paths 301 to 313 are substantially perpendicular to the forming surface 1*d*1. The connection paths 301 to 313 respectively have openings 3*a* (301*a* to 313*a*) in the longitudinal grooves 201 to 213.

The connection paths 3 and the openings 3*a* are arranged along the coolant channels 1*f*. Referring to FIGS. 1 and 2, this structure will be described by using the coolant channel 1*f*13, which is at the rightmost position, as an example. That is, the connection paths 3, which connect the coolant channel 1*f*13 to the longitudinal groove 213, are formed as connection paths 31301 to 31312 in order from the front side. The connection paths 3 respectively have the openings 3*a* (openings 313*a*01 to 313*a*12) in the longitudinal groove 213. In FIG. 2, only the openings 313*a*01, 313*a*07, 313*a*12, and some others are denoted by the numerals. The connection paths 3 and the openings 3*a* for the coolant channel 1*f*1 to 1*f*12 are denoted by the numerals in the same manner. In the punch 1, all the openings 3*a* are arranged at a regular pitch P01 (see FIG. 2) in the front-back direction.

In the punch 1, the transversal grooves 5 are formed so as to each connect a set of the connection paths 3 in the longitudinal grooves 2, the set of the connection paths 3 being located in the same row from the front side. In other words, the connection paths 3 are formed at intersections of the longitudinal grooves 2 and the transversal grooves 5, which are formed in a grid pattern. That is, the openings 301*a*01 to 313*a*12 are formed at intersections of a 12×13 grid. Accordingly, for example, the seventh connection path 3 and the seventh opening 3*a* (in the seventh row) from the front side that are formed in the sixth longitudinal groove 206 from the left side (in the sixth column) are respectively specified as a connection path 30607 and an opening 306*a*07 (see FIG. 2). Thus, the punch 1 according to the embodiment has grooves forming a 12×13 grid and 156 connection paths 30101 to 31312.

As described above, the transversal grooves 5 extend in the left-right direction. In the punch 1, the transversal grooves 5 intersect all the longitudinal grooves 201 to 213. The transversal grooves 5 include twelve transversal grooves 501 to 512 in order from the front side. In the punch 1, the twelve transversal grooves 5 extend parallel to each other and perpendicular to the longitudinal grooves 2.

Intermediate transversal grooves 6 are formed between adjacent transversal grooves 5 (located adjacent to each other in the front-back direction). In the punch 1, three intermediate transversal grooves 6 are formed between adjacent transversal grooves 5. Each of the intermediate transversal grooves 6 intersects and connects all the longitudinal grooves 201 to 213. The intermediate transversal grooves 6 extend parallel to the transversal grooves 5. Each of the intermediate transversal grooves 6 is denoted, for example, as an intermediate transversal groove 60506 shown in FIG. 2 or an intermediate transversal groove 61112 shown in FIG. 3. That is, when one of the intermediate transversal grooves 6 is located between the transversal grooves 505 and 506, which are respectively the fifth and sixth from the front side, the intermediate transversal groove 6 is referred to as the intermediate transversal groove 60506. When one of the intermediate transversal grooves 6 is located between the transversal grooves 511 and 512, which are respectively the eleventh and twelfth from the front side, the intermediate transversal groove 6 is referred to as the intermediate transversal groove 61112. In the punch 1, an intermediate transversal groove 60001 is formed in front of the transversal groove 501, and an intermediate transversal groove 61213 is formed in the back of the transversal groove 512.

FIG. 5 illustrates the three-dimensional structures of the longitudinal grooves 2, the transversal grooves 5, the intermediate transversal grooves 6, the openings 3*a*, the connection paths 3, and the coolant channels 1*f*. To be specific, FIG. 5 is a top perspective sectional view of a portion V of the punch 1 shown in FIG. 1 viewed from the front right, the portion V being cut from the punch 1 with a certain depth. FIG. 5 illustrates a connection path 30703 that connects the coolant channel 1*f*7 to the intersection of the longitudinal groove 207 and a transversal groove 503, a connection path 30803 that connects the coolant channel 1*f*8 to the intersection of the longitudinal groove 208 and the transversal groove 503, intermediate transversal grooves 60304, and the like. The connection paths 30703 and 30803 respectively have the openings 307*a*03 and 308*a*03, which are open toward outside. The inside diameter of each of the openings 3*a* (or the circumradius of each of the opening 3*a*) is, for example, 4 mm. In FIGS. 3 and 5, the inside diameter is larger than the width of each of the longitudinal grooves 207 and 208 and the width of each of the transversal grooves 503. However, this is not a limitation, and the inside diameter may be relatively smaller.

The longitudinal grooves 2, the transversal grooves 5, and the intermediate transversal grooves 6 may be formed by using any appropriate method. For example, electrochemical machining, chemical etching, cutting with a cutter, and the like may be used. In the case where the longitudinal grooves 2, the transversal grooves 5, or the intermediate transversal grooves 6 are provided in a plurality, it is preferable that these grooves be arranged parallel to each other, because nonuniform cooling can be further suppressed.

In the figures, the longitudinal grooves 2, the transversal grooves 5, and the intermediate transversal grooves 6 each have a rectangular cross sectional shape. However, the cross-sectional shape is not limited to a rectangular shape. Alternatively, the cross-sectional shape may be any appropriate shape, such as a semicircular shape, an arc shape, a triangular shape, a trapezoidal shape, or the like. It is preferable that these grooves be formed by using a cutter, because any cross-sectional shape may be formed by using a cutter having an appropriately-shaped cutting edge. In the case where the cross sectional shape of each of the grooves is a rectangular shape, the rectangle may have, for example, a width of 2.0 mm and a depth of 0.5 mm.

Hereinafter, the term "protruding portion Ts" (see FIG. 5) will refer to each of portions of the punch 1 that are segmented by the longitudinal grooves 2, the transversal grooves 5, and the intermediate transversal grooves 6 and that protrude from these grooves. The term "coolant flow portion F" will refer to a portion of the punch 1 in which the grooves 2, 5, and 6; the openings 3*a*; and the coolant flow portions F are formed. As described above, the coolant flow portion F extends over substantially the entire area of the forming surface 1*d*1 of the punch 1. In the punch 1, the transversal grooves 5 and the intermediate transversal grooves 6 are perpendicular to the longitudinal grooves 2, and each of these grooves has a rectangular cross sectional shape. Therefore, each of the protruding portions Ts has a rectangular-parallelepiped-shape having a small thickness. For example, the protruding portions Ts may have, for example, a length of 25 mm (in the longitudinal direction), a width of 2.0 mm, and a height of 0.5 mm.

Figure 6:
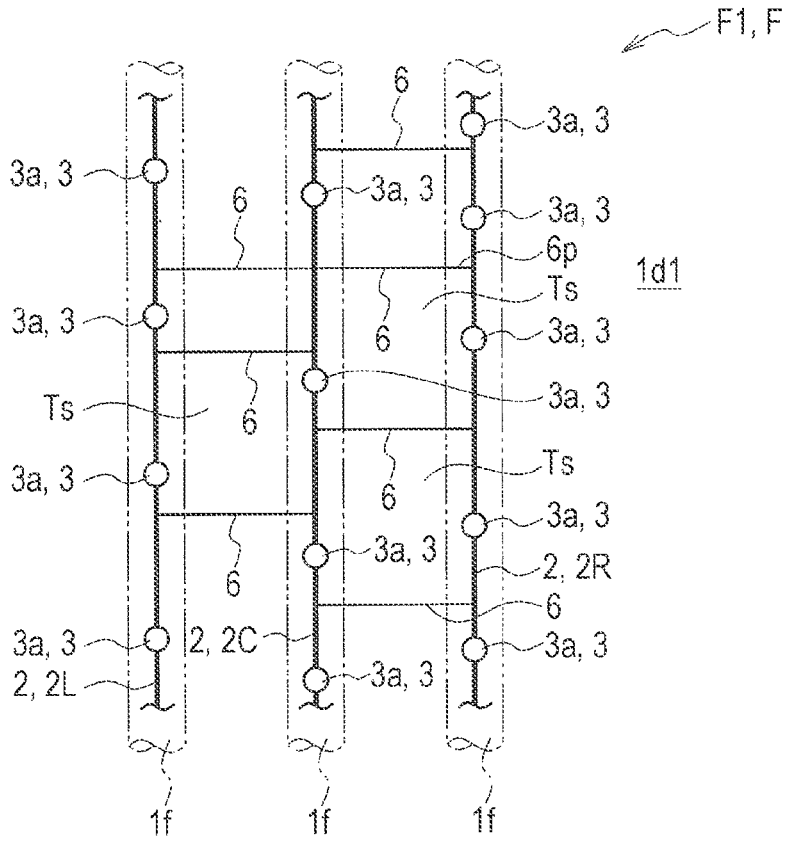
FIG. 6 is a schematic plan view illustrating a coolant flow portion of the punch.

Referring to FIG. 6, which is a schematic plan view, a pattern in which the longitudinal grooves 2, the transversal grooves 5, the intermediate transversal grooves 6, and the openings 3*a* are arranged in the coolant flow portion F will be described. FIG. 6 illustrates a part (coolant flow portion F1) of the coolant flow portion F having three longitudinal grooves 2 and corresponding three coolant channels 1*f*. In FIG. 6, for ease of understanding, the longitudinal grooves 2 are represented by thick solid lines and the intermediate transversal grooves 6 are represented by thin solid lines. The thicknesses of these lines do not limit the actual widths of these grooves.

As described above, the coolant channels 1*f* are formed in the punch 1 so as to be arranged side by side. The connection paths 3, which connect the coolant channels 1*f* to the forming surface 1*d*1, are formed so as to be arranged along a corresponding one of the coolant channels 1*f*. In the coolant flow portion F1, connection paths 3 that are connected to a coolant channel 1*f* have openings 3*a* that are open toward outside and that are arranged along a column in the front-back direction in the forming surface 1*d*1. The column of the openings 3*a* are formed at the bottom of corresponding one of the longitudinal grooves 2 formed in the forming surface 1*d*1. That is, the longitudinal groove 2 is formed so as to connect the column of openings 3*a*.

Between an opening 3*a* and an adjacent opening 3*a* that are arranged along one of the longitudinal grooves 2 in the front-back direction, there exits at least one intermediate transversal groove 6 that is connected to an adjacent longitudinal groove 2. For example, in a case where there are two adjacent longitudinal grooves (a longitudinal groove 2L and a longitudinal groove 2R shown in FIG. 6) on one side and on the other side of a longitudinal groove 2C, there exists an intermediate transversal groove 6 that is connected from the longitudinal groove 2C in the middle to at least one of the longitudinal grooves 2L and 2R. The intermediate transversal groove 6 may be connected to three or more longitudinal grooves 2. For example, FIG. 6 shows an intermediate transversal groove 6*p*, which is connected to all of three longitudinal grooves 2L, 2C, and 2R.

It is preferable but not necessary that the transversal grooves 5, which pass through the openings 3*a*, be formed. In the case where the transversal grooves 5 are formed, the transversal grooves 5 are not regarded as the intermediate transversal grooves 6. FIG. 6 illustrates a case where the transversal grooves 5 are not formed. As illustrated in FIG. 6, the shapes of the protruding portions Ts, which are segmented by the longitudinal grooves 2, the transversal grooves 5, and the intermediate transversal grooves 6, may differ from each other.

Figure 7:
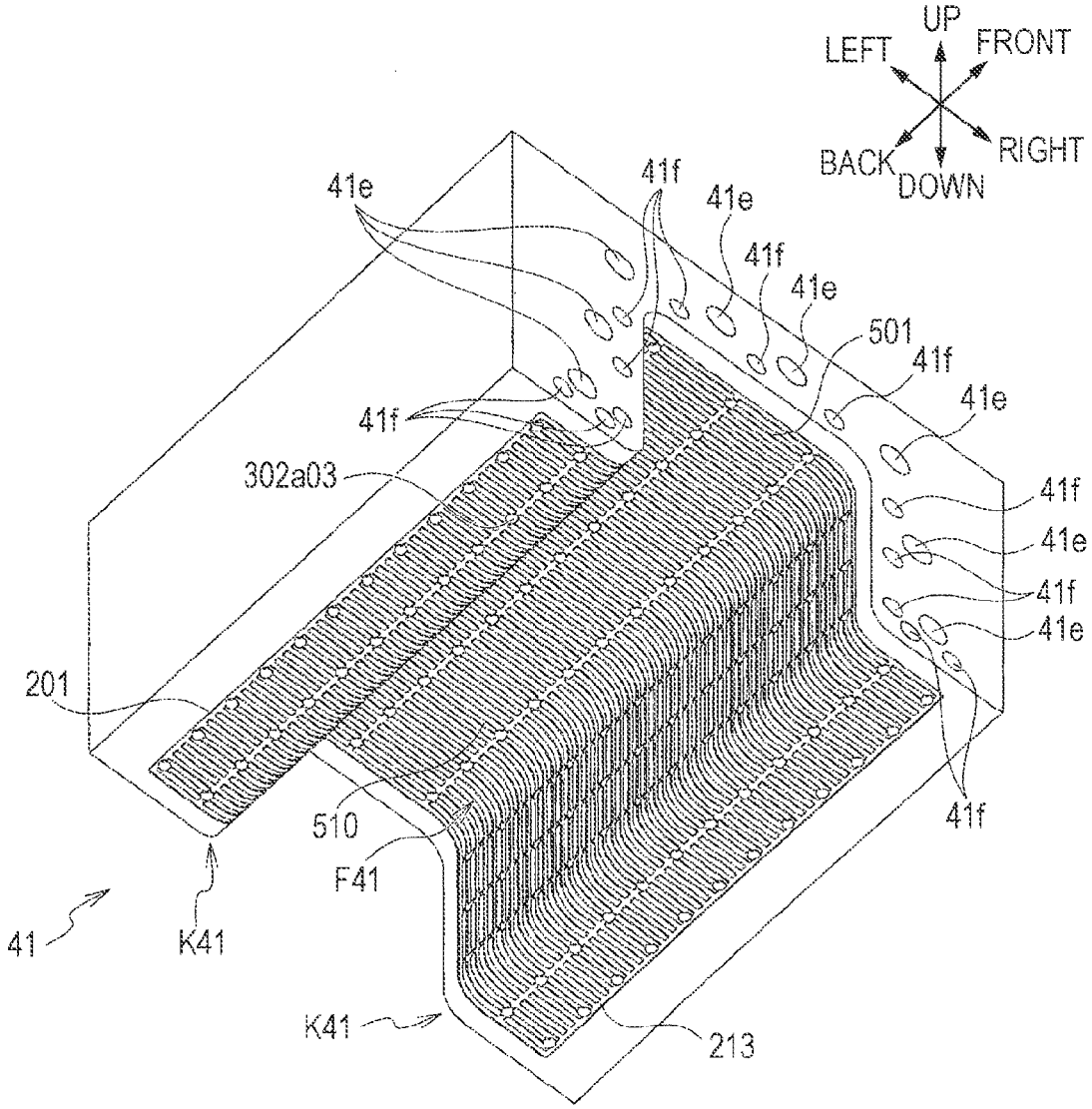
FIG. 7 is a perspective view of a die, which is a hot-pressing device according to an embodiment.

The die 41, which is paired with the punch 1, may have a structure similar to that of the punch 1, which includes the coolant flow portion F, the through-holes 1*e*, and the coolant channels 1*f*. FIG. 7 is a perspective view of the die 41 including a coolant flow portion F41, through-holes 41*e*, and coolant channels 41*f*. The coolant flow portion F41 corresponds to the coolant flow portion F, the through-holes 41*e* correspond to the through-holes 1*e*, and the coolant channels 41*f* correspond to the coolant channels 1*f*. In this example, the die 41 is used as an upper die. Alternatively, the die 41 may be used as a lower die.

The coolant flow portion F41 of the die 41 has thirteen coolant channels 41*f*, thirteen longitudinal grooves 2, twelve transversal grooves 5, and 156 connection paths 3 each having the opening 3*a*. Three intermediate transversal grooves 6 are formed between two adjacent transversal grooves 5. These grooves and openings are arranged in the coolant flow portion F41 in the same pattern as in the coolant flow portion F. In FIG. 7, only the longitudinal grooves 201 and 213, transversal grooves 501 and 510, and an opening 302*a*03 are denoted by numerals.

Next, referring to FIG. 8, a cooling system RM will be described. The cooling system RM supplies a coolant RB to and recovers the coolant RB from the coolant flow portion F of the punch 1 during a hot-press-forming operation that is performed by using the punch 1. The cooling system RM may also be used to supply the coolant RB to and recover the coolant RB from the coolant flow portion F41 of the die 41.

Figure 8:
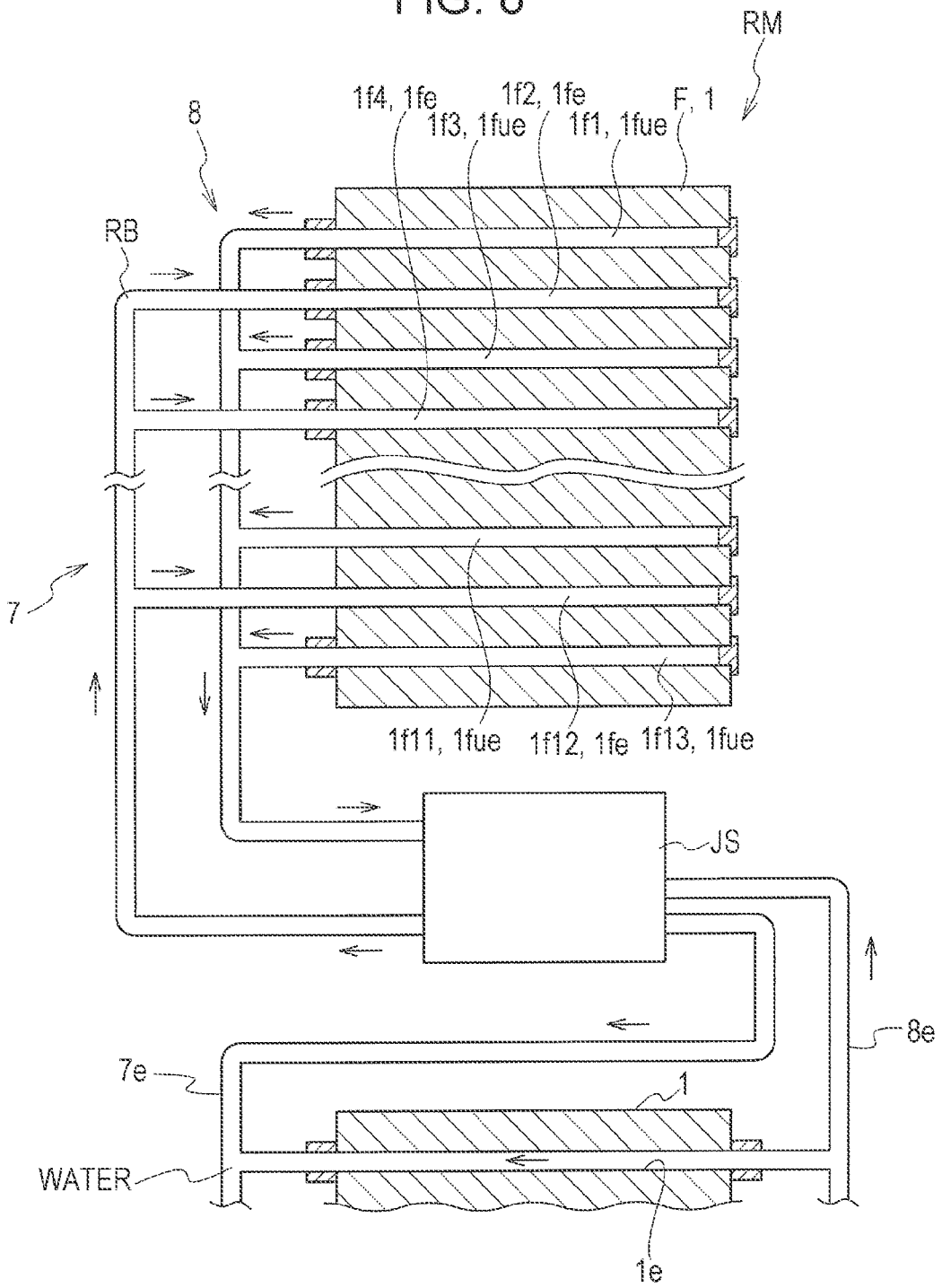
FIG. 8 is a schematic view illustrating a coolant circulation device connected to the punch.

FIG. 8 is a schematic view of the cooling system RM, including the coolant flow portion F of the punch 1, a coolant circulation device JS, an inlet pipe 7 for introducing the coolant RB into the coolant flow portion F, and a recovery pipe 8 for recovering the coolant RB from the coolant flow portion F. Seven coolant channels 1*f*, including the coolant channels 1*f*1 to 1*f*4 and the coolant channels 1*f*11 to 1*f*13, are illustrated in FIG. 8. Members other than the coolant channels 1*f*, such as the connection paths 3 having openings, which are open toward outside, are not illustrated.

As illustrated in FIG. 8, one end of the inlet pipe 7 is connected to the coolant circulation device JS. At the other end, the inlet pipe 7 branches into pipes that are connected to even-numbered coolant channels 1*f* (hereinafter, referred to as coolant channels 1*fe*). That is, the coolant channels 1*fe* include the coolant channels 1*f*2, 1*f*4, 1*f*6, . . . , and 1*f*12. One end of the recovery pipe 8 is connected to the coolant circulation device JS. At the other end, the recovery pipe 8 branches into pipes that are connected to odd-numbered coolant channels 1*f* (hereinafter, referred to as coolant channels 1*fue*). That is, the coolant channels 1*fue* include the coolant channels 1*f*1, 1*f*3, 1*f*5, . . . , 1*f*11, and 1*f*13. The coolant circulation device JS circulates the coolant RB by supplying the coolant RB to the inlet pipe 7 and recovering the coolant RB from the recovery pipe 8.

As illustrated in FIG. 8, the coolant circulation device JS also circulates a coolant (water or the like) through an inlet pipe 7*e*, the through-holes 1*e* in the punch 1, and a recovery pipe 8*e*.

In a case where the coolant flow portion F41, which corresponds to the coolant flow portion F, is formed in the die 41, the coolant circulation device JS is connected to the die 41 in the same way as to the punch 1. In this case, the coolant circulation device JS constantly circulates a coolant (water or the like) through the through-holes 1*e* in the die 41 during a press-forming process.

During a press-forming process, the coolant circulation device JS circulates the coolant RB through the coolant flow portion F (F41) only for a predetermined time in a state in which the upper die is maintained at the bottom dead center position. On the other hand, the coolant circulation device JS constantly circulates the coolant RB through the through-holes 1*e* during the press-forming process. A driving device (not shown) drives the upper die up and down. A controller (not shown) controls the operations of the driving device and the coolant circulation device JS.

Next, referring to FIGS. 9A to 9D, an example of a hot-press-forming process will be described. In this example, a workpiece W (for example, an aluminum-coated steel plate) is formed into a hat-like shape by using the punch 1 and the die 41. In this example, the punch 1 and the die 41 respectively have the coolant flow portion F and the coolant flow portion F41, and the coolant circulation device JS is connected to the coolant flow portions F and F41 so that a coolant is supplied to and recovered from the coolant flow portions F and F41. For simplicity, only the punch 1, the die 41, and the workpiece W are illustrated in FIGS. 9A to 9D. The press-forming process is divided into four steps respectively corresponding to FIGS. 9A to 9D, which will be described below in this order.

Figure 9A:
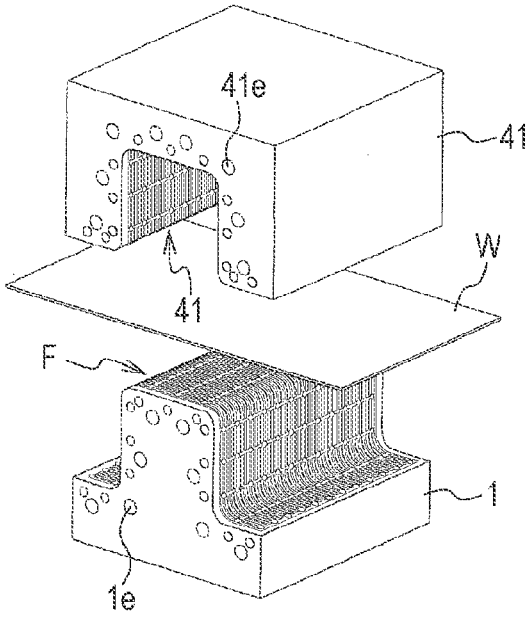
FIGS. 9A to 9D illustrate a hot-press-forming process performed by using the punch and the die.

A1) Workpiece Insertion Step (see FIG. 9A)

The punch 1 and the die 41 are cooled beforehand by causing the coolant circulation device JS to circulate water through the through-holes 1*e* and 41*e*, which are cooling water passages. Due to this cooling operation, the temperatures of the punch 1 and the die 41 are maintained to be, for example, 100° C. or lower during the press-forming process. At this time, the coolant circulation device JS does not supply the coolant RB to the coolant flow portions F and F41. A workpiece W, which has been heated beforehand to about 900° C., is inserted between the punch 1 and the die 41, which are being cooled.

Figure 9B:
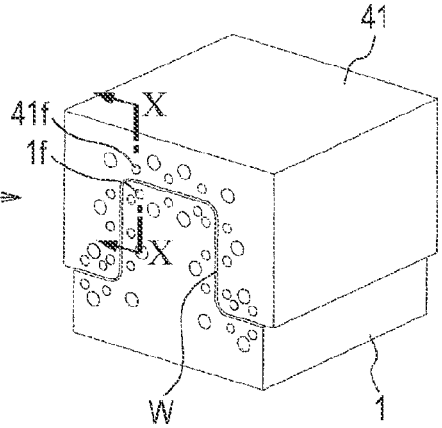

A2) Plastic Forming and Quench Hardening Step (See FIG. 9B)

The die 41 is lowered so that the workpiece W is plastically deformed into a shape corresponding to the shape of the die 41 and the punch 1. When the die 41 reaches the bottom dead center, the die 41 is maintained at the position for a predetermined time. During the predetermined time, the workpiece W is quench-hardened. That is, when the die 41 reaches the bottom dead center, the coolant circulation device JS starts circulating the coolant RB to the coolant flow portions F and F41. The workpiece W is quenched as heat is removed from the workpiece W not only through a direct contact between the workpiece W and the punch 1 and the die 41 but also through a direct contact between the coolant RB and the workpiece W, which is carried out by circulating the coolant RB through the longitudinal grooves 2, the transversal grooves 5, and the intermediate transversal grooves 6 of the coolant flow portions F and F41. Introduction of the coolant RB into the coolant flow portion F will be described in detail below. The protruding portions Ts of the coolant flow portions F and F41 of the punch 1 and the die 41 directly contact the workpiece W. Because heat is removed also by using the coolant RB, the workpiece W can be cooled considerably rapidly and quench-hardening can be finished in a short time. For example, quench-hardening may be finished in several seconds, and the upper die may need to be maintained at the bottom dead center for only 10 seconds or less. The workpiece W becomes a product Ws by being plastically deformed and quench-hardened. After circulating the coolant RB to the coolant flow portions F and F41 for a predetermined time, the coolant circulation device JS is stopped. The predetermined time, for which the coolant RB is circulated, is measured from when the coolant RB is started to be introduced to when the temperature of the workpiece W becomes, for example, about 200° C. or lower. The length of the predetermined time, the flow rate and the temperature of coolant RB, and the like are determined by performing a test press-forming operation before starting actual production so that the optimal temperature profile can be obtained in the cooling process.

Figure 9C:
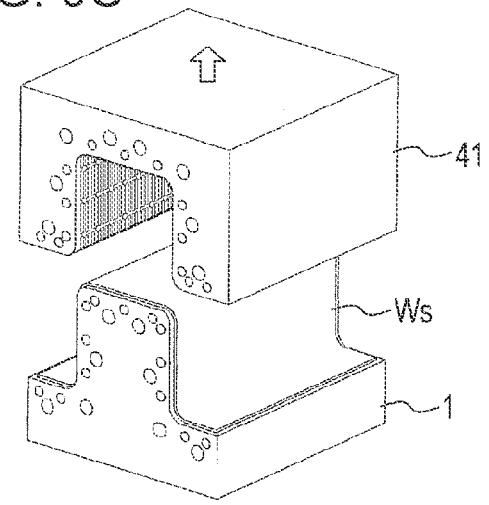

A3) Demolding Step (see FIG. 9C)

When circulation of the coolant RB is stopped after the coolant RB has been circulated through the coolant flow portions F and F41 for the predetermined time, the die 41 is raised so as to be separated from the punch 1. In order that the product Ws can be left on the punch 1, the strength with which the product Ws sticks to the punch 1 and ease of separating the product Ws from the die 41 are adjusted beforehand in a test press-forming operation.

Figure 9D:
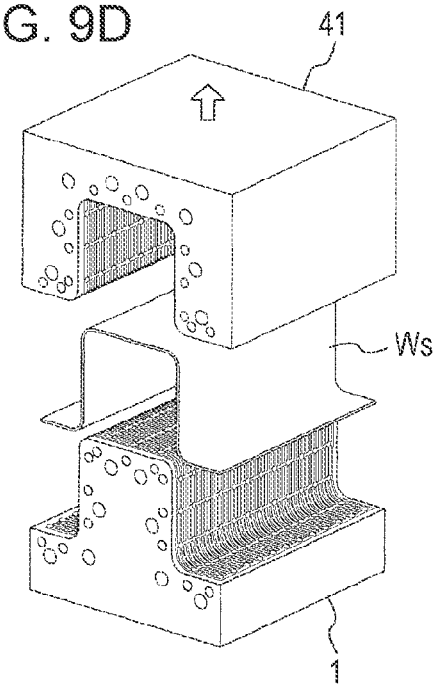

A4) Product Discharge Step (see FIG. 9D)

The die 41 is raised further, and the product Ws is removed from the punch 1 and discharged to the outside by using a discharge device (not shown). Through the steps described above, the workpiece W is hot-press-formed and the product Ws is obtained.

Figure 10:
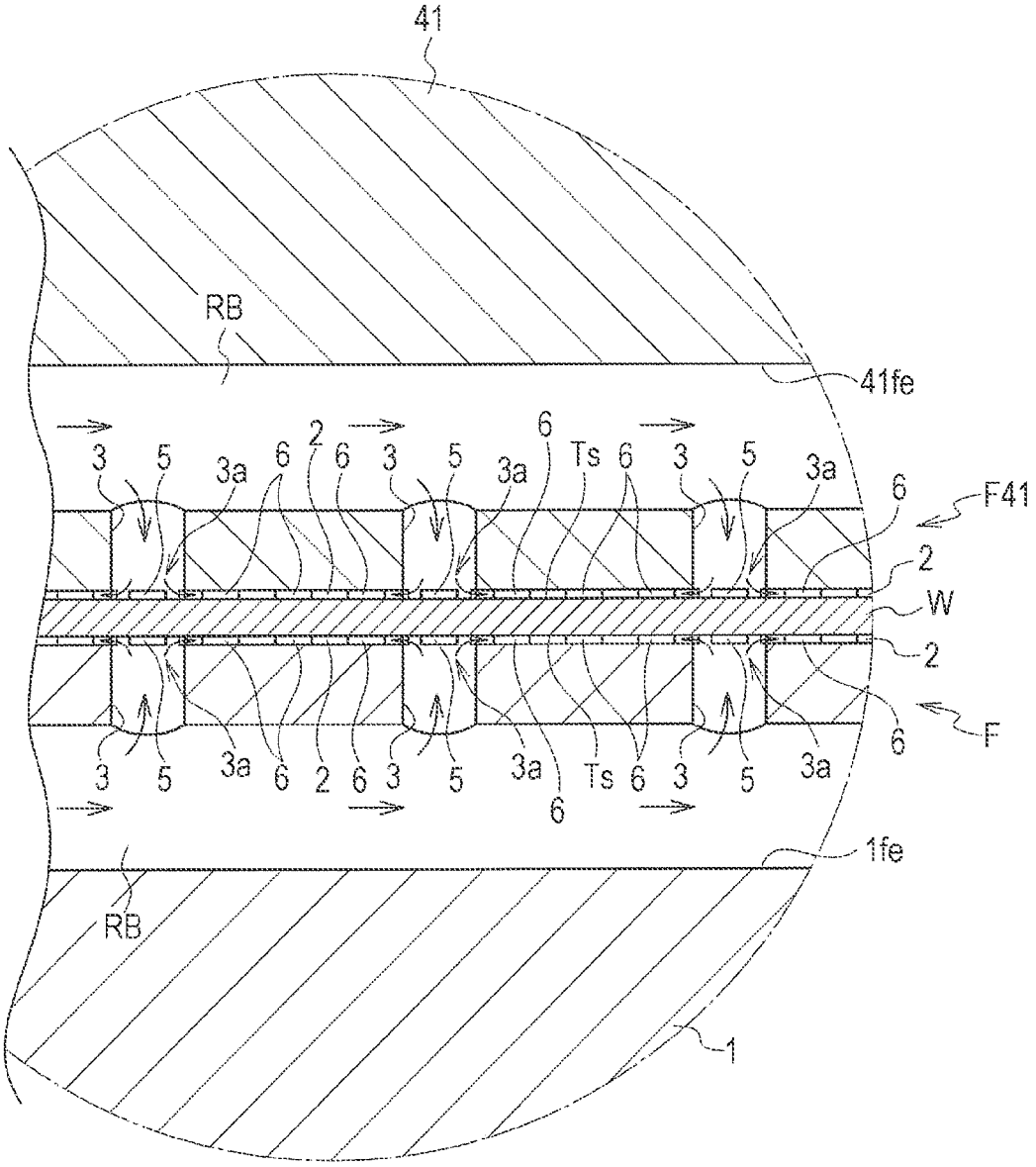
FIG. 10 is a cross-sectional view taken along line X-X of FIG. 9B.
Figure 11:
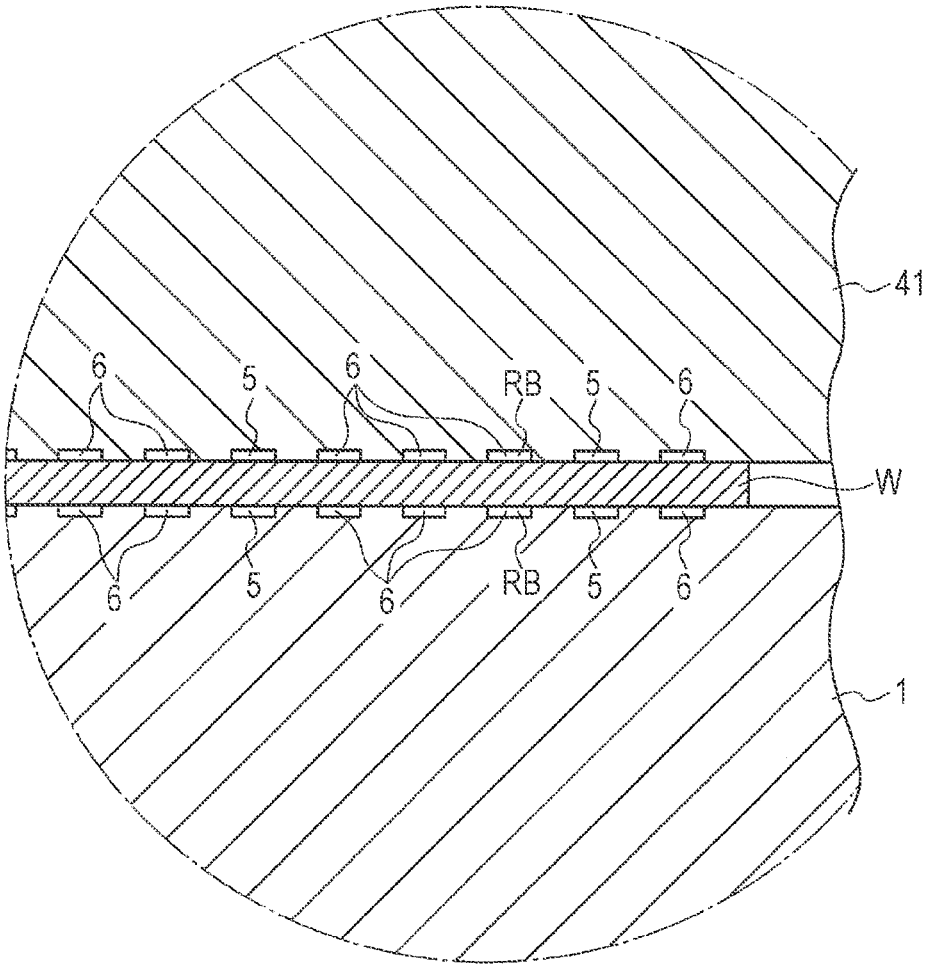
FIG. 11 is a cross-sectional view taken along line XI-XI of FIG. 2.
Figure 12:
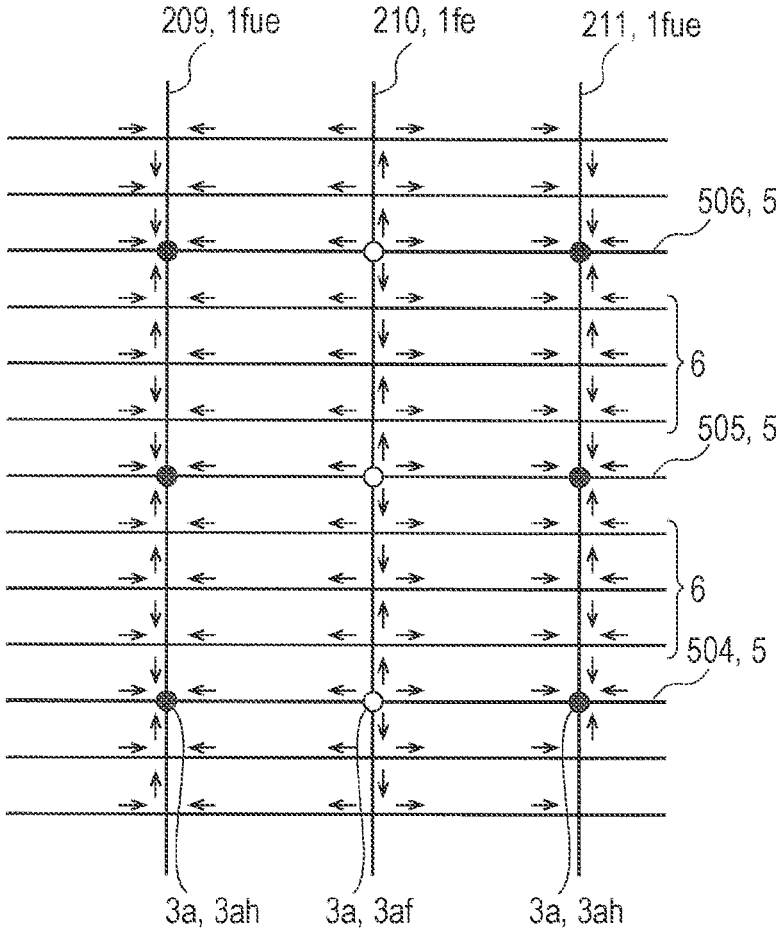
FIG. 12 is a schematic plan view illustrating flow of coolant in a coolant flow portion in a region XII shown in FIG. 1.

Next, referring to FIGS. 10 to 12, introduction of the coolant RB into the coolant flow portion F will be described in detail. FIG. 10 is a cross-sectional view taken along line X-X of FIG. 9B, illustrating a cross-section extending along the coolant channels 1*f* and 41*f*. FIG. 11 is a cross-sectional view taken along line XI-XI of FIG. 2, illustrating the transversal grooves 5 and the intermediate transversal grooves 6 in the state of FIG. 9B. FIG. 12 is a partial schematic plan view of the coolant flow portion F, illustrating flow of the coolant RB. FIG. 12 illustrates a portion of the coolant flow portion F including one of the longitudinal grooves 2 (210) connected to a corresponding one of the coolant channels 1*fe* and a pair of longitudinal grooves 2 (209 and 211) connected to the coolant channels 1*fue* that are adjacent to the coolant channel 1*fe* (that is, the coolant flow portion F in a region XII shown in FIG. 1, including the longitudinal grooves 209 to 211 and the transversal grooves 504 to 506).

FIG. 10 illustrates the punch 1, which is the lower die, and the die 41, which is an upper die and is maintained at the bottom dead center, and a workpiece W pressed between the punch 1 and the die 41. The coolant channels 1*f* and 41*f* are the even-numbered coolant channels 1*fe* and 41*fe*, to which the coolant RB is supplied from the coolant circulation device JS. Arrows indicate flow of the supplied coolant RB. (In FIG. 10, it is assumed that the coolant circulation device JS is connected to the left ends of the coolant channels 1*fe* and 41*fe*.) The coolant RB flowing through the coolant channels 1*fe* and 41*fe* flows into the connection paths 3, and flows into the longitudinal grooves 2 or the transversal grooves 5 through the openings 3*a*.

In FIG. 10, the longitudinal grooves 2 are located directly above and below the workpiece W so as to extend in the left-right direction of FIG. 10. The transversal grooves 5 and the intermediate transversal grooves 6 are formed so as to be connected to the longitudinal grooves 2 and so as to extend perpendicular to the longitudinal grooves 2 (in the front-back direction of the plane of FIG. 10). To be specific, the transversal grooves 5 are connected to the longitudinal grooves 2 at positions at which the connection paths 3 are formed, and three intermediate transversal grooves 6 are formed between two adjacent transversal grooves 5. The protruding portions Ts are located between the transversal groove 5 and the intermediate transversal groove 6 and between two intermediate transversal grooves 6. The punch 1 and the die 41 are in direct contact with the workpiece W at the protruding portions Ts. In FIG. 10, for simplicity, only one of the protruding portions of each of the punch 1 and the die 41 are shown by the symbol "Ts".

When the die 41, which is the upper die, is maintained at the bottom dead center, the workpiece W covers the opening sides of the longitudinal grooves 2, the transversal grooves 5, and the intermediate transversal grooves 6. Therefore, elongated spaces are formed between the workpiece W and these grooves so as to extend along the grooves. The coolant RB flows through these spaces. For example, the coolant RB flows from the coolant channels 1*fe* and 41*fe* to the longitudinal grooves 2 through the openings 3*a*. Then, the coolant RB flows into the intermediate transversal grooves 6, which extend in the front-back direction of the plane of FIG. 10. That is, irrespective of whether or not the coolant RB passes through the longitudinal grooves 2, the coolant RB ejected from the openings 3*a* flows into the transversal grooves 5 or the intermediate transversal grooves 6 and flows toward an adjacent one of the longitudinal grooves 2. For example, at the cross section of FIG. 11 (taken along line XI-XI of FIG. 2) the coolant RB flows from the back side toward the front side of the plane of FIG. 11.

FIG. 12 is a schematic plan view illustrating flow of the coolant RB along the longitudinal grooves 2, the transversal grooves 5, and the intermediate transversal grooves 6. In FIG. 12, for simplicity, each groove is represented by a solid line, the openings 3*a* through which a coolant is ejected (hereinafter, referred to as ejection openings 3*af*) are represented by white circles, the openings 3*a* through which the coolant is discharged (hereinafter, referred to as discharge openings 3*ah*) are represented by black circles, and the directions of flow of the coolant RB are indicated by arrows.

In each of the coolant flow portions F and F41, one of two adjacent longitudinal grooves 2 have only the ejection openings 3*af*, which are connected to the inlet pipe 7; and other longitudinal grooves 2 have only the discharge openings 3*ah*, which are connected to the recovery pipe 8. Accordingly, the ejection openings 3*af* and the discharge openings 3*ah* are alternately arranged along each of the transversal grooves 5 that intersect the longitudinal grooves 2. Thus, there exists the discharge opening 3*ah* for discharging the coolant RB in the vicinity of the ejection opening 3*af* for ejecting the coolant RB.

Therefore, the coolant RB that has directly flowed from the ejection opening 3*af* into the transversal groove 5 reaches the adjacent discharge opening 3*ah*, which is separated from the ejection opening 3*af* by only a very short distance, and is discharged from the discharge opening 3*ah* to the recovery pipe 8. The coolant RB that has directly flowed from the ejection opening 3*af* into the longitudinal groove 2 (210) flows into one of the intermediate transversal grooves 6 connected to the longitudinal groove 2 (210), the one of the intermediate transversal grooves 6 being located nearer to the ejection opening 3*af* than an adjacent ejection opening 3*af* in the longitudinal groove 2 (210) is, and then the coolant RB reaches an adjacent longitudinal groove 2 (209 or 211). Because the intermediate transversal grooves 6 are formed, two currents of the coolant RB that have flowed from two adjacent ejection openings 3*af* into the longitudinal groove 2 (210) toward each other flow into the intermediate transversal grooves 6 without becoming stagnant at a position between two ejection openings 3*af*, and further flow into an adjacent longitudinal groove 2 (209 or 211) without becoming stagnant.

The longitudinal grooves 2 (209 and 211), into which the coolant RB has flowed from another longitudinal groove 2 (210), have only the discharge openings 3*ah*. Therefore, the coolant RB, which has flowed from the longitudinal groove (210), reaches the discharge openings 3*ah* rapidly without being disturbed or becoming stagnant, and is discharged to the recovery pipe 8.

As described above, in each of the coolant flow portions F1 and F41, longitudinal grooves that have only the ejection openings 3*af* for ejecting the coolant RB and longitudinal grooves that have only the discharge opening 3*ah* for discharging the coolant RB are alternately arranged. Between any two adjacent openings 3*a* in one longitudinal groove, there exist intermediate transversal grooves 6 connected to an adjacent longitudinal groove. Accordingly, the path length along which the coolant flows from the ejection opening 3*af* for ejecting the coolant RB to the discharge opening 3*ah* for discharging the coolant RB is very small.

Because the coolant RB flows in a definite direction along each section of the longitudinal grooves 2 and the intermediate transversal grooves 6 (and the transversal grooves 5 in the case where the transversal grooves 5 are formed), the flow of the coolant RB does not become stagnant and the flow speed is high. Accordingly, the time from when the coolant RB is ejected from the ejection opening 3*af* to when the coolant RB is discharged from the discharge opening 3*ah* is very short.

Thus, the length along which the coolant RB flows and the contact time for which the coolant RB is in contact with the workpiece W from when the coolant is ejected from the ejection opening 3*af* to when the coolant RB is discharged from the discharge opening 3*ah* are very short. Moreover, because the coolant RB flows in a definite direction in each section of the groove and the flow does not become stagnant, the flow speed of the coolant RB is high. Therefore, an increase in the temperature of the coolant RB during the contact time is appropriately controlled, and heat can be efficiently removed from the workpiece W. Moreover, because the sufficiently cool coolant RB constantly contacts the hot workpiece W, the workpiece W can be cooled at a high speed. Accordingly, the product Ws can be manufactured with high productivity in the hot-press-forming process. Moreover, nonuniform cooling of the workpiece does not occur because the coolant RB reaches the entire surface of the workpiece W uniformly and rapidly. Accordingly, a defect of the product Ws due to nonuniform cooling does not occur.

The coolant flow portion F and the coolant flow portion F41 may be formed in any appropriate areas of the punch 1 and the die 41 with consideration of the distribution of the temperature or the distribution of the cooling speed along the surfaces of the punch 1 and the die 41 during a hot-press forming process. For example, a plurality of coolant flow portions F or a plurality of coolant flow portions F41 may be formed independently in the forming surface 1*d*1.

Figure 13:
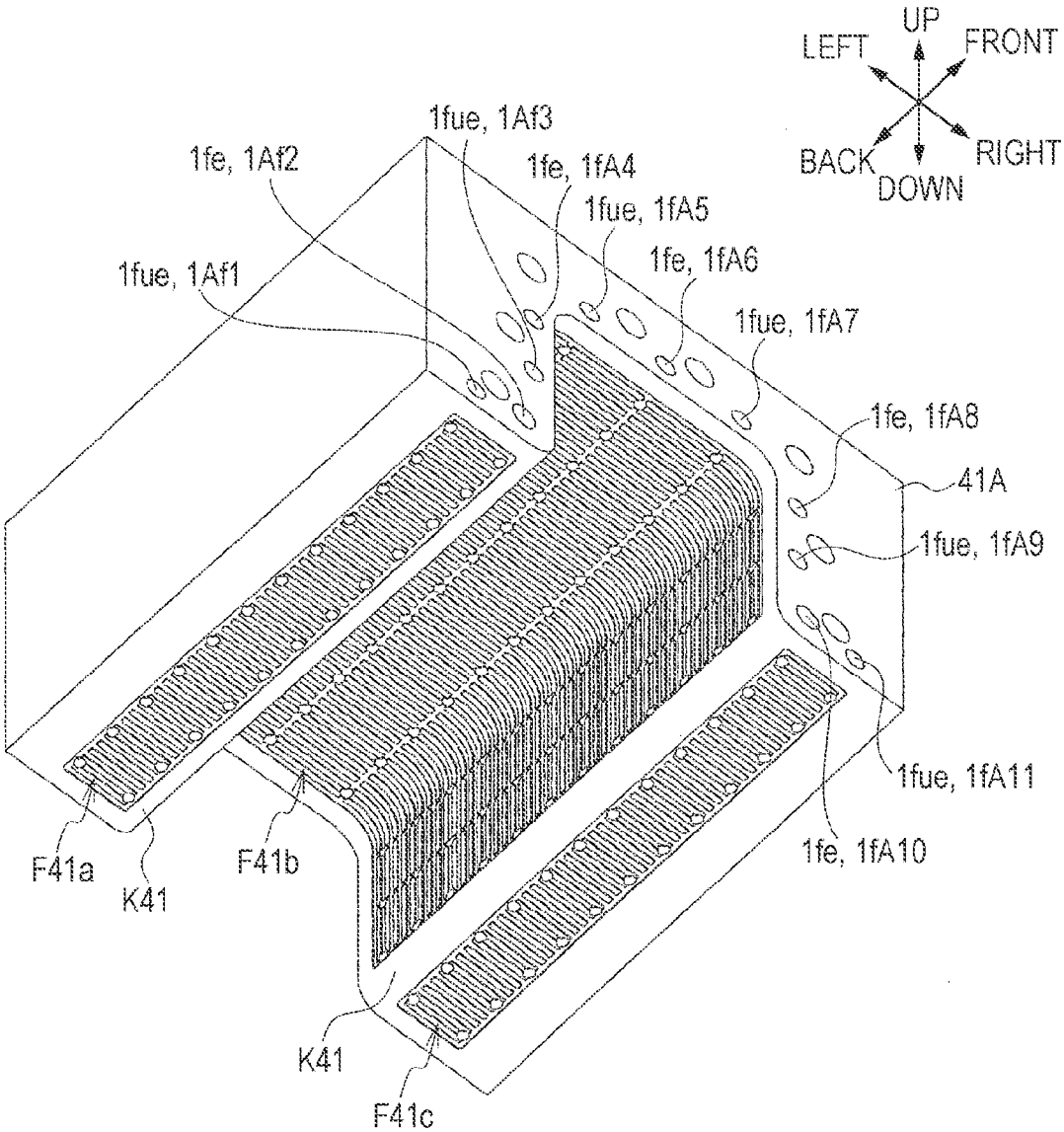
FIG. 13 is perspective view illustrating a modification of the die.
Figure 14:
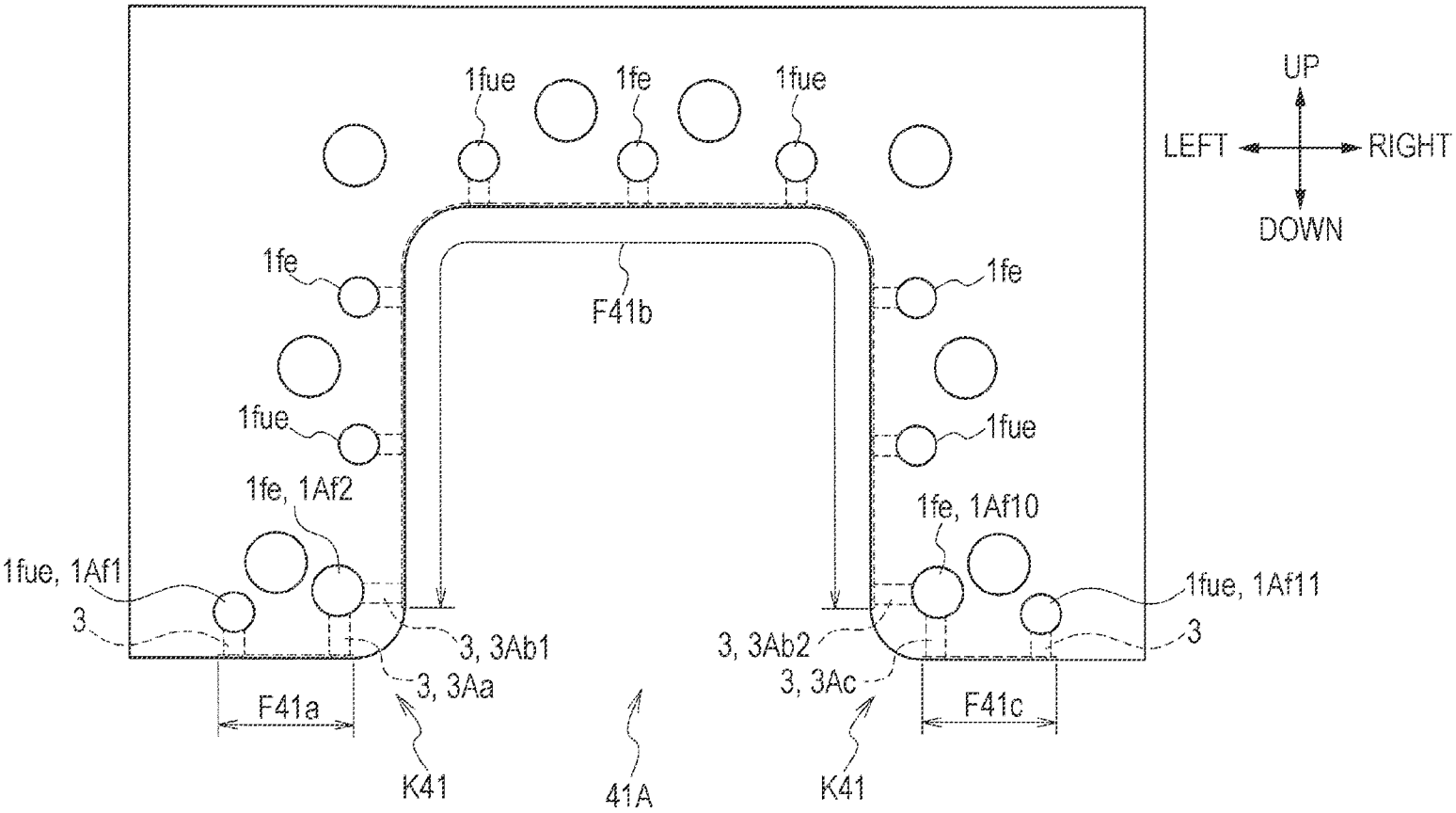
FIG. 14 is a front view illustrating the modification of the die.

Depending on the shape of the product to be formed, if there is a groove in a shoulder portion of the die 41 (rounded external corner portion, which will be hereinafter referred to as a shoulder portion K41, see FIG. 7), galling due to engagement of the groove with the workpiece may occur during a press-forming process or a mark of the groove may be formed on a surface of the product Ws. In order to avoid such a defect due to a groove, it is not necessary that the coolant flow portion F41 be formed at the shoulder portion K41 of the forming surface 1*d*1. This is an example of a case where a plurality of coolant flow portions F or a plurality of coolant flow portions F41 are independently formed in the forming surface 1*d*1. Referring to FIGS. 13 and 14, this case will be described.

FIG. 13 is a perspective view of a die 41A that does not have a coolant flow portion F41 at the shoulder portions K41. FIG. 14 a front view of the die 41A. In the die 41A, the coolant flow portion F41 includes three coolant flow portions F41*a* to F41*c*, which are disposed with the shoulder portions K41 therebetween. In FIG. 14, arrows indicate the areas in which the coolant flow portions F41*a* to F41*c* are formed. The coolant channels 1*f* include eleven coolant channels 1Af1 to 1Af11, which are arranged along a surface of the die 41A in this order from the left side. The coolant circulation device JS (not shown in FIG. 13) introduces the coolant RB into even-numbered coolant channels 1*fe*, which are connected to the inlet pipe 7. The coolant RB is recovered to the coolant circulation device JS from odd-numbered coolant channels 1*fue*, which are connected to the recovery pipe 8.

In the die 41A, each of the coolant channel 1Af2 and the coolant channel 1Af10, which are respectively located at the shoulder portions K41, has two connection paths 3 that are connected to two adjacent coolant flow portions. To be specific, the coolant channel 1Af2 has a connection path 3Aa, which is connected to the right end of the coolant flow portion F41*a*, and a connection path 3Ab1, which is connected to the lower left end of the coolant flow portion F41*b*. The coolant channel 1Af10 has a connection path 3Ab2, which is connected to the lower right end of the coolant flow portion F41*b*, and a connection path 3Ac, which is connected to the left end of the coolant flow portion F41*c*. That is, one coolant channel is shared by adjacent coolant flow portions. Thus, the number of coolant channels 1Af can be reduced (by two in the case of the die 41A), and therefore the cost of manufacturing the die 41A can be reduced.

Likewise, the punch 1 may have the structure described above, in which a coolant channel corresponding to a nearest pair of longitudinal grooves 2 of adjacent coolant flow portions is shared by these coolant flow portions. This structure can be also used in a case where adjacent coolant flow portions F are separately formed in the same plane.

Embodiments are not limited to the structures and the processes described above, and may be modified within the spirit and scope of the present disclosure.

It is not necessary that the entirety of the coolant flow portion F be formed in a grid pattern. For example, the coolant flow portion F may have independent longitudinal grooves in a part thereof, and the other parts of the coolant flow portion F may have a grid pattern. This structure may be used in a case where the shape of a hot-pressed product to be formed has a larger width at a middle portion thereof in the longitudinal direction. In this case, the coolant flow portion F may have independent longitudinal grooves in the middle portion.

Figure 15:
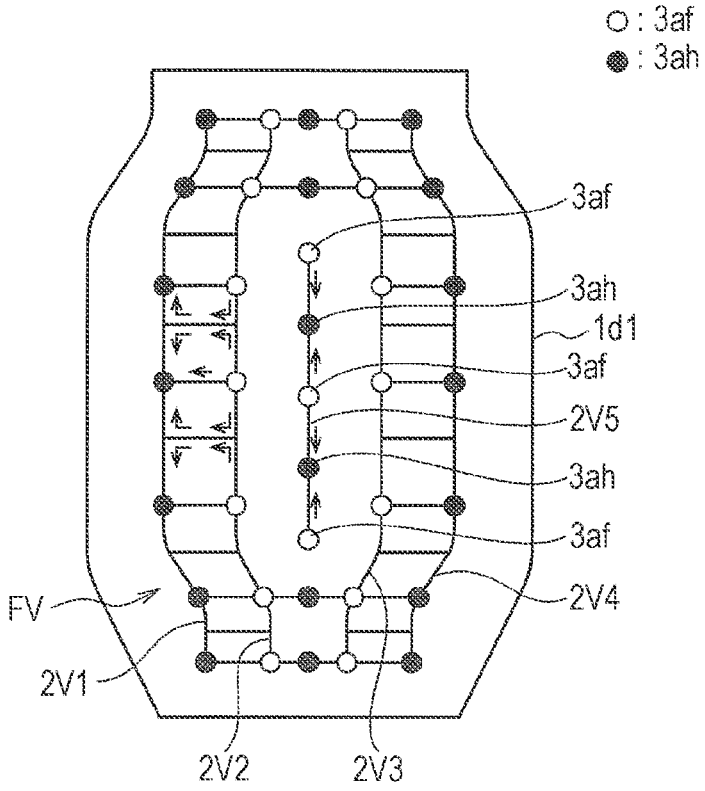
FIG. 15 is a schematic plan view illustrating a modification of the coolant flow portion.

FIG. 15 is schematic plan view illustrating a coolant flow portion FV that is formed in the forming surface 1*d*1 having a larger width at a middle portion thereof. As in FIG. 12, each groove is represented by a solid line, the ejection openings 3*af* from which the coolant is ejected are represented by white circles, and the discharge openings 3*ah* from which the coolant is discharged are represented by black circles. Some directions of flow of the coolant RB are indicated by arrows. Such notations are also used in FIGS. 16 to 19. The coolant flow portion FV shown in FIG. 15 includes four longitudinal grooves 2V1 to 2V4, which extend in the vertical direction of FIG. 15, and an independent longitudinal groove 2V5 at the center of a large-width portion at the middle thereof in the left-right direction. Transversal grooves and intermediate transversal grooves are not connected to the longitudinal groove 2V5. The openings 3*a* in the longitudinal groove 2V5 include ejection openings 3*af* for ejecting the coolant RB and discharge openings 3*ah* for discharging the coolant RB, which are alternately arranged along the groove 2V5 with substantially the same distance therebetween. In the coolant flow portion FV, the longitudinal grooves and the coolant channels 1*f*, which are formed inside and not shown in FIG. 15, are connected to each other in a complex manner. However, depending on the shape of the product, this structure is effective in terms of the cooling efficiency. Therefore, this structure may be used as a modification of the embodiments.

Figure 16:
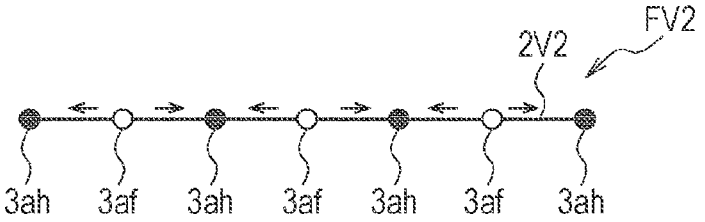
FIG. 16 is a schematic plan view illustrating another modification of the coolant flow portion.

Depending on the shape of the product, the coolant flow portion F may be a coolant flow portion FV2, which is a variant of this modification. As illustrated in FIG. 16, the coolant flow portion FV2 includes a groove and a plurality of opening formed in the groove so as to be separated from each other with distances therebetween. The openings include the ejection openings 3*af* and the discharge openings 3*ah*, which are alternately arranged with distances therebetween. Also in this case, the ejection openings 3*af* for ejecting the coolant RB and the discharge openings 3*ah* for discharging the coolant RB are located close to each other, and the coolant RB flows in a definite direction from one opening to another, so that the flow does not become stagnant and has a high speed. Accordingly, the workpiece W can be cooled rapidly in a quench-hardening process, and the productivity is increased. Moreover, nonuniform cooling does not occur because the coolant RB is rapidly and uniformly distributed to the entirety of the coolant flow portion FV2. Accordingly, a defect of the product Ws due to nonuniform cooling does not occur.

In a case where the coolant flow portions F and F41 of the punch 1 and the die 41, which are embodiments of the hot-pressing device, have a plurality of grooves that are arranged side by side, it is not necessary that the distances between adjacent grooves be constant. The grooves need not be parallel to each other.

Figure 17:
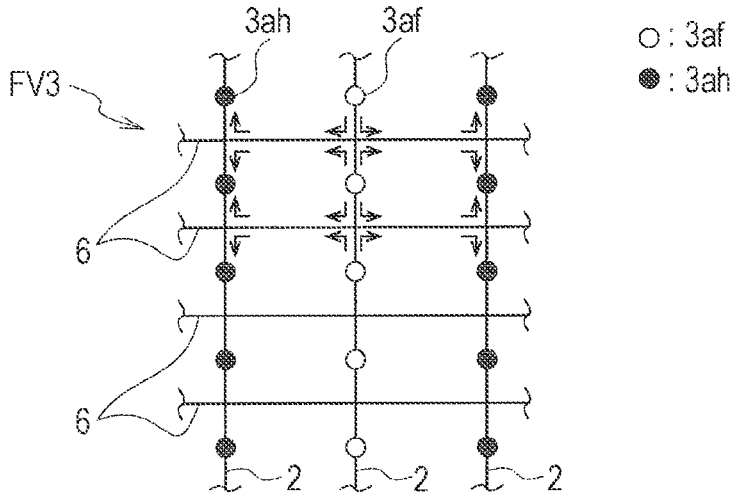
FIG. 17 is a schematic plan view illustrating another modification of the coolant flow portion.

It is not necessary that the transversal grooves 5 be formed. FIG. 17 illustrates a coolant flow portion FV3 that does not have the transversal grooves 5. Also in the coolant flow portion FV3, an intermediate transversal groove 6 is formed between two adjacent ejection openings 3*af* in the longitudinal groove 2 at the center of FIG. 17, and the intermediate transversal groove 6 is connected to each of adjacent longitudinal grooves 2. The intermediate transversal grooves 6 are connected to portions of the adjacent longitudinal grooves 2 between two adjacent discharge openings 3*ah*.

Figure 18:
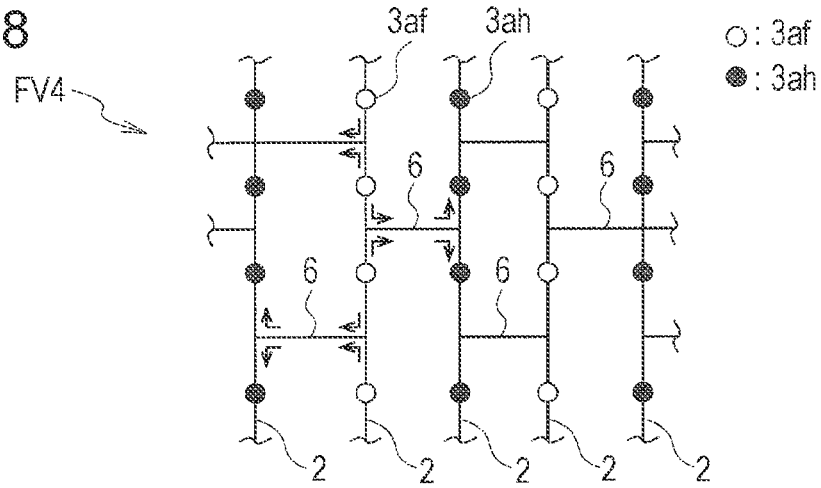
FIG. 18 is a schematic plan view illustrating another modification of the coolant flow portion.

It is not necessary that the intermediate transversal grooves 6, which are connection grooves, connect all the longitudinal grooves 2 in the coolant flow portion F. FIG. 18 illustrates a coolant flow portion FV4 having intermediate transversal grooves 6 that connect only a pair of adjacent longitudinal grooves 2.

Figure 19:
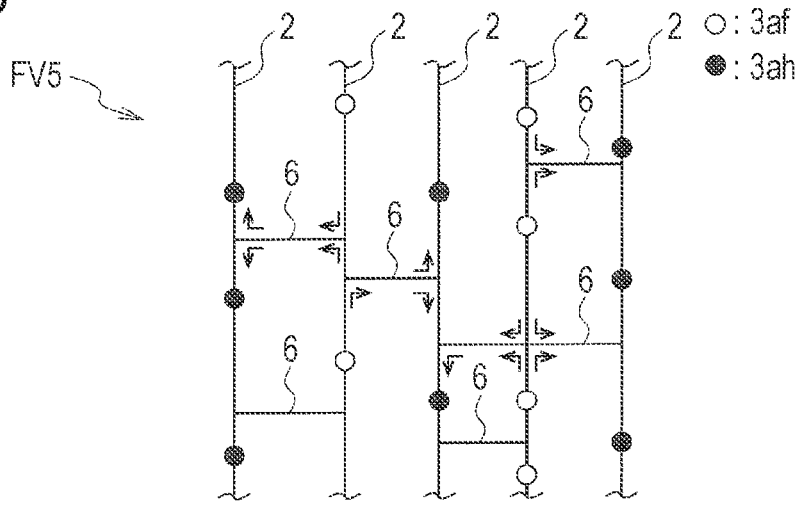
FIG. 19 is a schematic plan view illustrating another modification of the coolant flow portion.

The ejection openings 3*af* and the discharge openings 3*ah* may be formed along the longitudinal grooves 2 in any appropriate number and with any appropriate distances therebetween. FIG. 19 illustrates a coolant flow portion FV5, which is a modification in this respect. Also in this case, between two adjacent ejection openings 3*af* in a longitudinal groove 2, there exists an intermediate transversal groove 6 that is connected to a position between two adjacent discharge openings 3*ah* in an adjacent longitudinal groove 2.

In the coolant flow portions FV3 to FV5, the ejection openings 3*af* for ejecting the coolant RB and the discharge openings 3*ah* for discharging the coolant RB are located close to each other. Therefore, the coolant RB flows in a definite direction from one opening to another, so that the flow does not become stagnant and has a high speed. Accordingly, the workpiece W can be cooled rapidly in a quench-hardening process, and the productivity is increased. Moreover, nonuniform cooling does not occur because the coolant RB is rapidly and uniformly distributed to the entirety of each of the coolant flow portions FV3 to FV5. Accordingly, a defect of the product Ws due to nonuniform cooling does not occur.

In the embodiments and their modifications, the depths, the widths, and the cross-sectional shapes of the grooves are not limited and may be appropriately set. The grooves need not be linear and may be curved. The cross-sectional shape and the flow area of each connection path 3 are not limited and may be appropriately set. The shape and the area of each opening 3*a* are not limited and may be set appropriately set. The punch 1 and the die 41 may be made of a steel material generally used for a hot-pressing device. The coolant RB is not limited to water described above. Any coolant used for a hot-press-forming operation (such as a silicone oil) may be used.

The ratio of the area over which the protruding portions Ts contact the workpiece W and the area over which the coolant RB contacts the workpiece W (that is, the sum of the areas of the opening sides of the longitudinal groove 2, the transversal groove 5, and the intermediate transversal groove 6) on the forming surface 1*d*1 is not limited and may be appropriately set. In a case where the product Ws obtained by hot-press-forming the workpiece W is to be welded by, for example, spot welding, it is preferable that the position of one of the protruding portions Ts be set so that the protruding portion Ts contacts a portion of the workpiece W to be welded in a state in which the upper die is maintained at the bottom dead center. By making the protruding portion Ts contact the portion to be welded, a possibility that an edge of one of the grooves contacts the portion and uneven areas are formed on the surface can be avoided. Because uneven areas due to the grooves are not formed on the surface of the workpiece W, the weldability of the product Ws can be improved.

It is not necessary that both of the coolant flow portion F of the punch 1 and the coolant flow portion F41 of the die 41 be formed. Only one of coolant flow portions F and F41 may be formed. It is not necessary that the positions and the shapes of the coolant flow portions F and F41 are not limited to those that correspond to each other when the workpiece W is placed therebetween. Instead, the positions and the shapes of coolant flow portion F and F41 of the punch 1 and the die 41 may be freely and appropriately set.

The coolant flow portion F (or F41), which is formed in the punch 1 (or the die 41) according to the embodiments, has the following structure: the longitudinal grooves 2 having only the ejection opening 3*af* for ejecting the coolant RB and the longitudinal grooves 2 having only the discharge opening 3*ah* for discharging the coolant RB are alternately arranged, and there exists an intermediate transversal groove 6 between adjacent openings 3*a* in one of the longitudinal grooves and connected to an adjacent one of the longitudinal grooves. It is not necessary that this structure be provided in the entirety of the coolant flow portion F (or F41) and may be provided in only a part of the coolant flow portion F1 (or F41). As long as this structure is provided in at least a part of the coolant flow portion F1 (or F41), as compared with a case where this structure is not provided, the cooling speed is increased and the time required for a quench-hardening operation is reduced, and an advantage of an increase in the productivity can be obtained.

It is not necessary that the coolant channel 1*f* be a though-hole extending from one surface to an opposing surface of the punch 1. Instead, the coolant channel 1*f* may be a so-called blind hole, which has an opening only in one of the surfaces.

In the example illustrated in FIG. 8, the inlet pipe 7 is connected to the even-numbered coolant channels 1*f* (the coolant channels 1*fe*) and the recovery pipe 8 is connected to the odd-numbered coolant channels 1*f* (the coolant channels 1*fue*). However, this is not a limitation, and the inlet pipe 7 may be connected to the odd-numbered coolant channel 1*fue* and the recovery pipe 8 may be connected to the even-numbered coolant channels 1*fe*.

With the embodiments and their modifications, for the time from when the coolant RB is ejected from the ejection opening 3*af* to when the coolant RB is discharged from the discharge opening 3*ah*, the number of times the direction of flow of the coolant RB changes (and the coolant RB flows into other grooves) is very small. To be specific, in a case where the transversal grooves 5 are formed, the number of times the direction of flow of the coolant RB changes is only zero (directly introduced into the transversal groove 5) or twice (the coolant RB flows through the longitudinal groove 2, through the intermediate transversal groove 6, and into an adjacent longitudinal groove 2). In a case where the transversal groove 5 is not formed, the number of times the direction of flow of the coolant RB changes is only twice (through the longitudinal groove 2, through the intermediate transversal groove 6, and into an adjacent longitudinal groove 2). Accordingly, flow of coolant RB is not likely to be impeded and the coolant RB flows at a high speed without becoming stagnant. This is due to a structure in which a plurality of longitudinal grooves 2 are formed and the ejection openings 3*af* and the discharge openings 3*ah* are alternately arranged along different longitudinal grooves 2.

In a case where the grooves are curved, it is preferable that the curves have small curvatures in order that the flow speed of the coolant RB can be efficiently increased. If the direction of flow of the coolant RB changes at an acute angle, it is difficult for the coolant RB to flow smoothly. Therefore it is preferable that the grooves be arranged in a grid-like pattern because, by doing so, the direction of flow of the coolant RB is made to change at a right angle. Moreover, the number of steps for forming a die can be decreased and the flow speed of the coolant RB can be increased.

With the embodiments and their modifications, the flow speed of the coolant RB is increased. Therefore, it is not necessary to make the distances between adjacent longitudinal grooves 2 be too small. Instead of decreasing the distances between adjacent longitudinal grooves 2, it is preferable to increase the distances between adjacent longitudinal grooves 2 and to increase the number of the intermediate transversal grooves 6, thereby increasing the path lengths of the intermediate transversal grooves 6, because the flow of the coolant RB can be made smoother and the flow speed can be increased further by doing so. Moreover, in this case, the manufacturing cost can be reduced because the number of the coolant channels 1*f* can be decreased. Accordingly, it is preferable that the protruding portion Ts have an elongated shape, that is, that the ratio of the length L (distance in the longitudinal direction) to the width D be large (see FIG. 5 for examples of L and D). For example, it is preferable that $10 \leq L/D$.

The embodiments and their modifications described above may be used also in a case where the shape of the product Ws is not a substantially hat-like shape or a shape having a larger width at the middle portion thereof in the longitudinal direction.

What is claimed is:

1. A hot-pressing device for hot-press-forming a workpiece into a predetermined shape, the hot-pressing device comprising:

a forming surface having a shape corresponding to the predetermined shape; and a plurality of coolant channels formed therein so as to be arranged side by side and each having an opening in a side surface that is located on a side thereof when the forming surface is viewed from above or below, wherein the forming surface comprises a plurality of grooves formed therein so as to correspond to the coolant channels, a plurality of connection holes formed in each of the grooves so as to be connected to one of the coolant channels corresponding to the groove, the connection holes having openings at positions separated from each other, and a first connection groove connecting a portion of one of the grooves located between two adjacent connection holes to another one of the grooves located adjacent to the one of the grooves.

2. The hot-pressing device according to claim 1, wherein the forming surface further comprises a second connection groove that intersects the one of the grooves at a position at which one of the connection holes has the opening and that connects the one of the grooves to the other one of the grooves located adjacent to the one of the grooves.

3. The hot-pressing device according to claim 2, wherein the plurality of grooves and the first connection groove are formed in a grid pattern.

4. The hot-pressing device according to claim 1, wherein the plurality of grooves and the first connection groove are formed in a grid pattern.

5. A hot-pressing device for hot-press-forming a workpiece into a predetermined shape, the hot-pressing device comprising:

an upper die and a lower die that move closer to and away from each other so as to hot-press-form the workpiece, at least one of the upper die and the lower die comprising a forming surface having a shape corresponding to the predetermined shape, a plurality of coolant channels formed therein so as to be arranged side by side and each having an opening in a side surface thereof, a plurality of grooves formed in the forming surface so as to correspond to the coolant channels, a plurality of connection holes formed in each of the grooves so as to be connected to one of the coolant channels corresponding to the groove, the connection holes having openings at positions separated from each other, and a first connection groove connecting a portion of one of the grooves located between two adjacent connection holes to another one of the grooves located adjacent to the one of the grooves;

an inlet pipe connected to one of the coolant channels;

a recovery pipe connected to another one of the coolant channels located adjacent to the one of the coolant channels; and a coolant circulation device that circulates a coolant by introducing the coolant into the inlet pipe and recovering the coolant from the recovery pipe.

6. The hot-pressing device according to claim 5, wherein the forming surface further comprises a second connection groove that intersects the one of the grooves at a position at which one of the connection holes has the opening and that connects the one of the grooves to the other one of the grooves located adjacent to the one of the grooves.

7. The hot-pressing device according to claim 6, wherein the plurality of grooves and the first connection groove are formed in a grid pattern.

8. The hot-pressing device according to claim 5, wherein the plurality of grooves and the first connection groove are formed in a grid pattern.

9. A method of manufacturing a hot-pressed product having a predetermined shape by hot-pressing a workpiece by moving an upper die and a lower die closer to and away from each other, the method comprising:

preparing the upper die and the lower die, at least one of the upper die and the lower die comprising a forming surface having a shape corresponding to the predetermined shape, a plurality of coolant channels formed therein so as to be arranged side by side and each having an opening in a side surface thereof, a plurality of grooves formed in the forming surface so as to correspond to the coolant channels, a plurality of connection holes formed in each of the grooves so as to be connected to one of the coolant channels corresponding to the groove, the connection holes having openings at positions separated from each other, and a first connection groove connecting a portion of one of the grooves located between two adjacent connection holes to another one of the grooves located adjacent to the one of the grooves;

inserting the workpiece, which has been heated, between the upper die and the lower die;

deforming the workpiece by moving the upper die closer to the lower die and maintaining the upper die at a bottom dead center position; and cooling the workpiece with a coolant by introducing the coolant into one of the plurality of coolant channels and recovering the coolant from another one of the coolant channels located adjacent to the one of the coolant channels in a state in which the upper die is maintained at the bottom dead center position.

10. The method of manufacturing a hot-pressed product according to claim 9, wherein, in a case where the hot-pressed product is to be welded, while the upper die is maintained at the bottom dead center position, a protruding portion of the at least one of the upper die and the lower die segmented by the plurality of grooves and the first connection groove is made to contact a portion of the workpiece to be welded.

* * * * *